US009329508B2

(12) United States Patent
Lawton et al.

(10) Patent No.: US 9,329,508 B2
(45) Date of Patent: May 3, 2016

(54) EMULSION AGGREGATION PROCESS

(71) Applicant: XEROX CORPORATION, Norwalk, CT (US)

(72) Inventors: David John William Lawton, Stoney Creek (CA); David R. Kurceba, Hamilton (CA); Frank Ping-Hay Lee, Oakville (CA); Daniel McDougall McNeil, Georgetown (CA); Santiago Faucher, Oakville (CA)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 13/850,654

(22) Filed: Mar. 26, 2013

(65) Prior Publication Data

US 2014/0295346 A1 Oct. 2, 2014

(51) Int. Cl.
*G03G 9/08* (2006.01)
*G03G 9/087* (2006.01)

(52) U.S. Cl.
CPC ..... *G03G 9/0825* (2013.01); *G03G 9/0804* (2013.01); *G03G 9/0827* (2013.01); *G03G 9/08711* (2013.01)

(58) Field of Classification Search
CPC ..... G03G 9/0804; G03G 9/0806
USPC ..... 430/137.14
See application file for complete search history.

(56) References Cited

U.S. PATENT DOCUMENTS

| | | | |
|---|---|---|---|
| 3,847,604 | A | 11/1974 | Hagenbach et al. |
| 4,295,990 | A | 10/1981 | Verbeek et al. |
| 4,935,326 | A | 6/1990 | Creatura et al. |
| 4,937,166 | A | 6/1990 | Creatura et al. |
| 5,236,629 | A | 8/1993 | Mahabadi et al. |
| 5,278,020 | A | 1/1994 | Grushkin et al. |
| 5,290,654 | A | 3/1994 | Sacripante et al. |
| 5,308,734 | A | 5/1994 | Sacripante et al. |
| 5,330,874 | A | 7/1994 | Mahabadi et al. |
| 5,344,738 | A | 9/1994 | Kmiecik-Lawrynowicz et al. |
| 5,346,797 | A | 9/1994 | Kmiecik-Lawrynowicz et al. |
| 5,348,832 | A | 9/1994 | Sacripante et al. |
| 5,364,729 | A | 11/1994 | Kmiecik-Lawrynowicz et al. |
| 5,366,841 | A | 11/1994 | Patel et al. |
| 5,370,963 | A | 12/1994 | Patel et al. |
| 5,403,693 | A | 4/1995 | Patel et al. |
| 5,405,728 | A | 4/1995 | Hopper et al. |
| 5,418,108 | A | 5/1995 | Kmiecik-Lawrynowicz et al. |

(Continued)

FOREIGN PATENT DOCUMENTS

GB 1 442 835 7/1976

*Primary Examiner* — Christopher Rodee
(74) *Attorney, Agent, or Firm* — Pillsbury Winthrop Shaw Pittman LLP

(57) ABSTRACT

The method of manufacturing toners disclosed herein includes a continuous temperature ramp and coalescence process that involves continuously passing toner slurry, such as an aggregated toner slurry, through at least one heat exchanger before being subjected to a cooling step. The heat exchanger is pressurized, so the temperature of the slurry may be increased above the atmospheric boiling point of water without boiling the water component of the slurry. Because of these higher temperatures, the coalescence step can be completed more quickly than in conventional batch processes. More than two heat exchangers may be connected in the coalescence step, yielding multiple ramping/cooling temperature steps, ability to inject components, or recycling heat from the process to reduce energy consumption.

11 Claims, 2 Drawing Sheets

(56) References Cited

U.S. PATENT DOCUMENTS

| | | | | |
|---|---|---|---|---|
| 5,496,676 | A | 3/1996 | Croucher et al. | |
| 5,501,935 | A | 3/1996 | Patel et al. | |
| 5,527,658 | A | 6/1996 | Hopper et al. | |
| 5,585,215 | A | 12/1996 | Ong et al. | |
| 5,650,255 | A | 7/1997 | Ng et al. | |
| 5,650,256 | A | 7/1997 | Veregin et al. | |
| 5,723,253 | A | 3/1998 | Higashino et al. | |
| 5,744,520 | A | 4/1998 | Kmiecik-Lawrynowicz et al. | |
| 5,747,215 | A | 5/1998 | Ong et al. | |
| 5,763,133 | A | 6/1998 | Ong et al. | |
| 5,766,818 | A | 6/1998 | Smith et al. | |
| 5,804,349 | A | 9/1998 | Ong et al. | |
| 5,827,633 | A | 10/1998 | Ong et al. | |
| 5,840,462 | A | 11/1998 | Foucher et al. | |
| 5,853,943 | A | 12/1998 | Cheng et al. | |
| 5,853,944 | A | 12/1998 | Foucher et al. | |
| 5,863,698 | A | 1/1999 | Patel et al. | |
| 5,869,215 | A | 2/1999 | Ong et al. | |
| 5,902,710 | A | 5/1999 | Ong et al. | |
| 5,910,387 | A | 6/1999 | Mychajlowskij et al. | |
| 5,916,725 | A | 6/1999 | Patel et al. | |
| 5,919,595 | A | 7/1999 | Mychajlowskij et al. | |
| 5,922,501 | A | 7/1999 | Cheng et al. | |
| 5,925,488 | A | 7/1999 | Patel et al. | |
| 5,928,829 | A | 7/1999 | Cheng et al. | |
| 5,977,210 | A | 11/1999 | Patel et al. | |
| 6,063,827 | A | 5/2000 | Sacripante et al. | |
| 6,120,967 | A | 9/2000 | Hopper et al. | |
| 6,309,787 | B1 * | 10/2001 | Cheng | 430/137.14 |
| 6,576,389 | B2 | 6/2003 | Vanbesien et al. | |
| 6,593,049 | B1 | 7/2003 | Veregin et al. | |
| 6,617,092 | B1 | 9/2003 | Patel et al. | |
| 6,627,373 | B1 | 9/2003 | Patel et al. | |
| 6,638,677 | B2 | 10/2003 | Patel et al. | |
| 6,656,657 | B2 | 12/2003 | Patel et al. | |
| 6,656,658 | B2 | 12/2003 | Patel et al. | |
| 6,664,017 | B1 | 12/2003 | Patel et al. | |
| 6,673,505 | B2 | 1/2004 | Jiang et al. | |
| 6,756,176 | B2 | 6/2004 | Stegamat et al. | |
| 6,830,860 | B2 | 12/2004 | Sacripante et al. | |
| 7,037,633 | B2 | 5/2006 | Hopper et al. | |
| 7,432,031 | B2 * | 10/2008 | Mizutani et al. | 430/137.14 |
| 7,785,763 | B2 | 8/2010 | Agur et al. | |
| 8,252,501 | B2 | 8/2012 | Maezawa et al. | |
| 2006/0222991 | A1 | 10/2006 | Sacripante et al. | |
| 2007/0020553 | A1 * | 1/2007 | Marcello et al. | 430/137.14 |
| 2007/0082287 | A1 * | 4/2007 | Wolfe et al. | 430/137.14 |
| 2008/0063965 | A1 * | 3/2008 | Lai et al. | 430/137.14 |
| 2008/0107989 | A1 | 5/2008 | Sacripante et al. | |
| 2010/0092886 | A1 | 4/2010 | Vanbesien et al. | |
| 2011/0097664 | A1 | 4/2011 | Nosella et al. | |
| 2011/0250535 | A1 * | 10/2011 | Vanbesien et al. | 430/137.14 |
| 2011/0318685 | A1 | 12/2011 | Vanbesien et al. | |
| 2012/0183898 | A1 | 7/2012 | Faucher et al. | |
| 2012/0258398 | A1 | 10/2012 | Zhou et al. | |

* cited by examiner

EMULSION AGGREGATION PROCESS

TECHNICAL FIELD

This disclosure is generally directed to processes for making toner compositions. More specifically, the present disclosure relates to processes for making toner compositions incorporating continuous ramp and coalescence processes.

RELATED APPLICATIONS

U.S. Patent Application Publication No. 2012/0183898 to Faucher et al. discloses a continuous stirred tank reactor system for the production of particles by emulsion aggregation, comprising: at least one feed tank of raw materials; at least one reactor for facilitating an aggregation process; optionally at least one reactor for facilitating a shell material addition process; at least one reactor for facilitating a freeze process; at least one reactor for facilitating a chelating process; at least one reactor for facilitating a temperature ramp-up process; and at least one reactor for facilitating a coalescence process; wherein the reactors are sequentially assembled in a series configuration, each of the reactors operating with a mechanical agitator.

U.S. Patent Application Publication No. 2007/0020553 to Marcello et al. discloses a method of making toner particles, comprising: mixing a latex emulsion, a colorant emulsion, an optional wax emulsion, and optional additives in a first reactor to form a slurry; discharging the slurry from the first reactor to a second reactor through a homogenizer; heating the slurry in the second reactor to form aggregated particles in said slurry; discharging the aggregated particles and slurry from the second reactor to a third reactor; heating the aggregated particles and slurry in the third reactor to coalesce the aggregated particles into toner particles; discharging the toner particles and slurry from the third reactor to a fourth reactor; cooling the toner particles; optionally classifying said toner particles to remove coarse particles; and optionally washing and drying said toner particles, wherein the first reactor, second reactor, third reactor, and fourth reactor comprise at least two different reactors.

The entire disclosures of the above-mentioned application publications are totally incorporated herein by reference.

CITED REFERENCES

U.S. Patent Application Publication No. 2011/0318685 to Vanbesien et al. discloses a method of making toner particles, comprising forming a slurry by mixing together an emulsion comprising: a latex of a first polymer or resin, a colorant, an optional wax, and optional additives; heating the slurry to a predetermined aggregation temperature and maintaining the slurry within 0.5° C. of the aggregation temperature to form aggregated particles in the slurry; forming a shell on the aggregates by adding a latex of a second polymer or resin to the slurry while mixing; freezing aggregation of particles by raising a pH of the aggregated particles and slurry mixture to a freezing aggregation pH; heating the mixture to a predetermined coalescence pH adjustment temperature, and then lowering the pH of the mixture to a predetermined coalescence pH; heating the mixture to a predetermined coalescence temperature; and maintaining the temperature of the mixture at the coalescence temperature to coalesce the aggregates into toner particles.

The entire disclosures of the above-mentioned application publication are totally incorporated herein by reference.

BACKGROUND

Emulsion aggregation (EA) toners are used in forming print and/or xerographic images. Emulsion aggregation techniques typically involve the formation of an emulsion latex of resin particles that have a small size of from, for example, about 5 to about 500 nanometers in diameter, by heating the resin, optionally with solvent if needed, in water, or by making a latex in water using an emulsion polymerization. A colorant dispersion, for example of a pigment dispersed in water, optionally with additional resin, may be separately formed. The colorant dispersion may be added to the emulsion latex mixture, and an aggregating agent or complexing agent may then be added and/or aggregation may otherwise be initiated to form aggregated toner particles. The aggregated toner particles may be heated to enable coalescence/fusing, thereby achieving aggregated, fused toner particles.

Exemplary emulsion aggregation toners include acrylate-based toners, such as those based on styrene acrylate toner particles as illustrated in, for example, U.S. Pat. No. 6,120,967, the disclosure of which is totally incorporated herein by reference.

In conventional EA processes, batch processes may be used for preparing toners. Batch processes feature long processing times and consume a great deal of energy. The ramp/coalescence process is particularly time and energy intensive, as the entire batch is ramped to the desired coalescence temperature and maintained at that temperature for coalescence to occur. For example, in large-scale production of EA toner, increasing the temperature of toner to the desired coalescence temperature and carrying out the coalescence step may take upwards of 10 hours.

Additionally, in a batch process, high jacket temperatures and low fluid velocity at the walls under stirring can lead to fouling of the reactor walls. This necessitates additional down-time in the production cycle to allow for cleaning in order to restore the heat transfer from the jacket to the fluid in the vessel. This additional down-time further increases the total amount of time for running an extended production cycle to allow for cleaning after a set number of batches.

Therefore, there is a need for improved ramp and coalescence processes for use in preparing toner compositions without the extensive time and energy used in batch process methods.

SUMMARY

In some embodiments, the present disclosure provides methods for making EA toner compositions comprising a continuous ramp and coalescence processes. The methods may include forming a slurry comprising particles by preparing an emulsion containing a latex of at least one polymer resin, optionally a wax dispersion, optionally a colorant dispersion, and optional additives; aggregating the particles from the slurry; optionally adding a second polymer latex and further aggregating the particles to form a shell on the particles; freezing aggregation of the particles; coalescing the aggregated particles to form toner particles by continuously passing the particles through a heat exchanger; and recovering the toner particles from the heat exchanger. The circularity of the particles before entering the heat exchanger may be between about 0.900 and about 0.940, and the circularity of the toner particles recovered from the heat exchanger may be between about 0.940 and about 0.999. After the aggregated particles are coalesced to form toner particles by being continuously passed through the heat exchanger, the toner particles may be cooled.

In some embodiments, the present disclosure also provides methods of making toner particles, which may include forming a slurry containing particles by mixing together at least one emulsion comprising a latex of at least one polymer resin, optionally a wax dispersion, optionally a colorant dispersion, and optional additives; aggregating the particles from the slurry; optionally adding a second polymer latex and further aggregating the particles to form a shell on the particles; freezing aggregation of the particles coalescing the aggregated particles to form toner particles by continuously passing the particles through a system containing at least one heat exchanger; and recovering toner particles from the system containing at least one heat exchanger. The temperature of the at least one heat exchanger may be from about 100° C. to about 150° C. The circularity of the particles before entering the system containing at least one heat exchanger may be from about 0.900 and about 0.940, and the circularity of the toner particles recovered from the system may be from about 0.940 to about 0.999. After the aggregated particles are coalesced to form toner particles, the toner particles may be cooled.

In some embodiments, the present disclosure provides methods of making toner particles that includes forming a slurry containing particles by mixing together an emulsion including a latex of at least one polymer resin, optionally a wax dispersion, optionally a colorant dispersion, and optional additives; aggregating the particles from the slurry; optionally adding a second polymer latex and further aggregating the particles to form a shell on the particles; freezing aggregation of the particles by continuously passing the particles through a system containing at least three heat exchangers; and recovering toner particles from the system containing at least three heat exchangers. The system containing at least three heat exchangers may be pressurized, and at least two of the at least three heat exchangers may be connected in a closed loop. The circularity of the particles before entering the heat exchanger system may be between about 0.900 and about 0.940, and the circularity of the particles recovered from the system may be between about 0.940 and about 0.999. After the toner particles are coalesced to form toner particles, the toner particles may be cooled.

EMBODIMENTS

Figure 1:
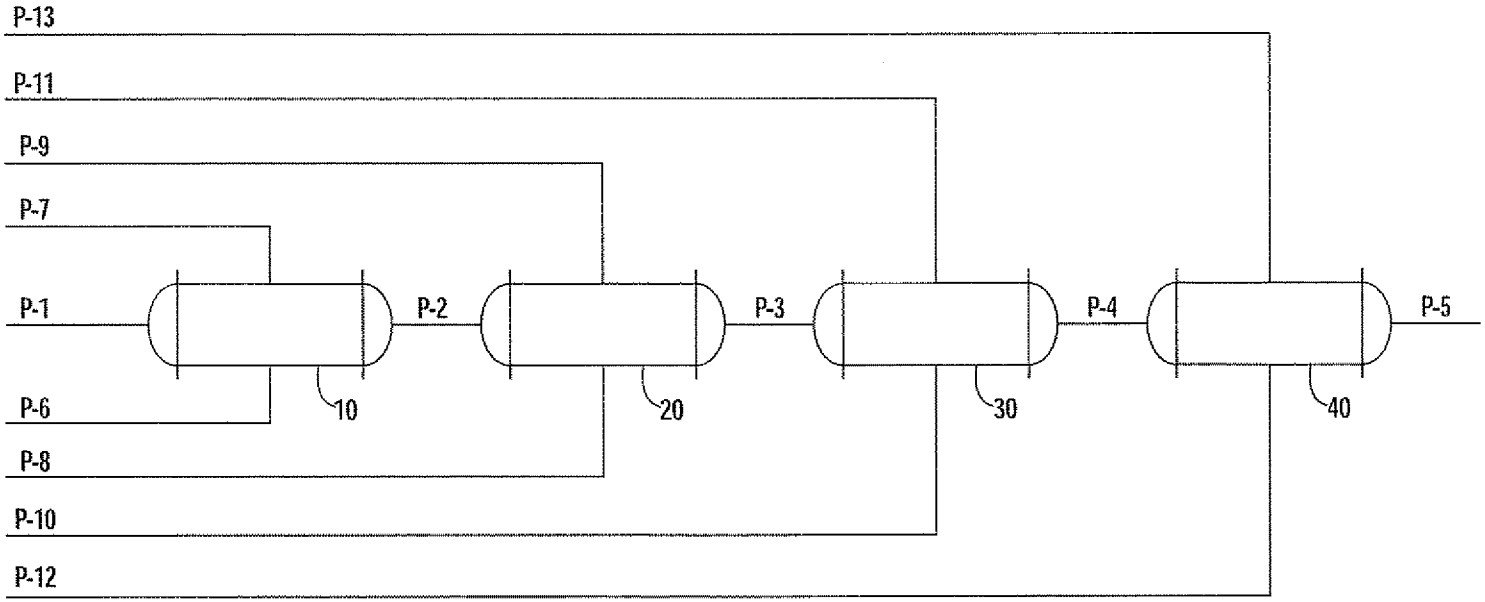
FIG. 1 illustrates an embodiment of a system incorporating four heat exchangers for carrying out ramp/coalescence in an emulsion/aggregation process.

In this specification and the claims that follow, singular forms such as "a," "an," and "the" include plural forms unless the content clearly dictates otherwise. All ranges disclosed herein include, unless specifically indicated, all endpoints and intermediate values. The term "at least one" refers, for example, to instances in which one of the subsequently described circumstances occurs, and to instances in which more than one of the subsequently described circumstances occurs.

The term "continuous" refers, for example, to a process that may be performed without interruption, such as a process in which raw materials are continuously processed to completed products. While a continuous process may thus be conducted 24 hours per day, 7 days per week, it is understood that the process may be periodically stopped, such as for maintenance purposes.

"Optional" or "optionally" refer, for example, to instances in which subsequently described circumstance may or may not occur, and include instances in which the circumstance occurs and instances in which the circumstance does not occur.

The terms "one or more" and "at least one" refer, for example, to instances in which one of the subsequently described circumstances occurs, and to instances in which more than one of the subsequently described circumstances occurs. Similarly, the terms "two or more" and "at least two" refer, for example to instances in which two of the subsequently described circumstances occurs, and to instances in which more than two of the subsequently described circumstances occurs.

"High gloss" refers, for example, to the gloss of a material being from about 20 to about 100 gloss units, such as from about 30 to about 90 gloss units (GGU), or from about 40 to about 70 GGU or from about 45 to about 75 GGU, as measured by the Gardner Gloss metering unit; for example on a coated paper, such as Xerox 120 gsm Digital Coated Gloss papers, or on plain paper such as Xerox 90 gsm Digital Color Xpressions+paper.

As used herein, the modifier "about" used in connection with a quantity is inclusive of the stated value and has the meaning dictated by the context (for example, it includes at least the degree of error associated with the measurement of the particular quantity). When used in the context of a range, the modifier "about" should also be considered as disclosing the range defined by the absolute values of the two endpoints. For example, the range "from about 2 to about 4" also discloses the range "from 2 to 4."

In embodiments, the present disclosure provides emulsion/aggregation processes for the production of toner particles, which optionally may be toner particles having a core/shell structure. More specifically, in embodiments, the present disclosure provides emulsion/aggregation methods for the production of toner particles incorporating a continuous ramp and coalescence process. In embodiments, the toner particles produced by the methods of the present disclosure are high-gloss toner particles.

Toner Particles

The emulsion/aggregation toner particles, which optionally may be toner particles having a core/shell structure (as discussed below), produced by the methods of the present disclosure are generally comprised of at least a latex emulsion polymer resin and a colorant dispersion. Such toner particles may also include a wax dispersion, a coagulant, and other optional additives.

Any suitable emulsion aggregation procedure may be used and modified to incorporate the continuous ramp and coalescence process of the present disclosure in forming such emulsion/aggregation toner particles. These procedures may include process steps including aggregating an emulsion containing polymer binder, optionally one or more waxes, one or more colorants, one or more surfactants, an optional coagulant, and one or more additional optional additives to form aggregates; subsequently freezing the particle aggregates, and optionally an initial coalescing or fusing of the aggregates, and then recovering, optionally washing, and optionally drying the obtained emulsion/aggregation toner particles.

Such emulsion aggregation processes may comprise dispersing in water a latex of a first polymer resin having a first glass transition temperature ($T_g$) and a colorant dispersion, and optionally adding to the emulsion a wax dispersion, and mixing the emulsion with high shear to homogenize the mixture.

Following the preparation of the above mixture, an aggregating agent may be added to the mixture. The slurry may then be heated to a predetermined aggregation temperature of from about 30° C. to about 60° C., such as, for example, from about 30° C. to about 50° C., or from about 24° C. to about 60° C., or from about 49° C. to about 54° C. The heating may be conducted at a controlled rate of about 0.1° C./minute to about 2° C./minute, such as from about 0.3° C./minute to about 0.8° C./minute. In some embodiments, the above steps are completed and primary aggregated particles formed before the continuous ramp and coalescence processes of the present disclosure are commenced, which results in the final toner particles.

Any suitable aggregating agent may be utilized in the processes of the present disclosure to form the toner particles, which optionally may be toner particles having a core/shell structure (as discussed below). Suitable aggregating agents include, for example, aqueous solutions of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the glass transition temperature (Tg) of the resin.

In embodiments, the aggregating agent may be added to the mixture utilized to form a toner in an amount of, for example, from about 0.01 percent to about 8 percent by weight, such as from about 0.1 percent to about 1 percent by weight, or from about 0.15 percent to about 0.8 percent by weight, of the resin in the mixture.

To control aggregation and subsequent coalescence of the particles, the aggregating agent may be metered into the mixture over time. For example, the agent may be metered into the mixture over a period of from about 5 to about 240 minutes, such as from about 30 to about 200 minutes. The addition of the agent may occur while the mixture is maintained under stirred conditions, such as from about 50 revolutions per minute to about 1,000 revolutions per minute, or from about 100 revolutions per minute to about 500 revolutions per minute, or from about 200 to about 400 revolutions per minute. The addition of the agent may also occur while the mixture is maintained at a temperature that is below the glass transition temperature of the resin discussed above, such as from about 30° C. to about 90° C., or from about 35° C. to about 70° C., or from about 40° C. to about 65° C.

The particles may be permitted to aggregate until an initial predetermined desired particle size is obtained. In some embodiments, a particle composition comprising the initial predetermined desired particles is obtained before the continuous ramp and coalescence processes of the present disclosure are commenced, which results in the final toner particles. A predetermined desired size (of the initial particles, or the final toner particles) refers to the desired particle size to be obtained as determined prior to formation, and the particle size being monitored during the growth process until such particle size is reached. Samples may be taken during the growth process and analyzed, for example with a Coulter Counter, for average particle size. In some embodiments, this aggregation to obtain particles that may be acted on by the continuous ramp and coalescence processes of the present disclosure may proceed by maintaining the elevated temperature, or slowly raising the temperature to, for example, from about 40° C. to about 100° C., and holding the mixture at this temperature for a time from about 0.5 hours to about 6 hours, or from about 1 hour to about 5 hours, while maintaining stirring, to provide the initial aggregated particles. Once the predetermined desired particle size is reached, then the growth process is halted. In embodiments, the predetermined desired particle size is within the desired size of the final toner particles, such as within 10% of the desired diameter of the final toner particles, or within 2% of the desired diameter of the final toner particles, within 0.5% of the desired diameter of the final toner particles.

The growth and shaping of the initial particles following addition of the aggregation agent may be accomplished under any suitable conditions. For example, the growth and shaping may be conducted under conditions in which aggregation occurs separate from any optional initial coalescence, which may occur before the particles are acted on by the continuous ramp and coalescence processes of the present disclosure to arrive at the final toner particles. For separate aggregation and coalescence stages, the aggregation process may be conducted under shearing conditions at an elevated temperature, for example of from about 40° C. to about 90° C., in embodiments from about 45° C. to about 80° C., which may be below the glass transition temperature of the resin in order to achieve the initial predetermined desired particles that may be acted on by the continuous ramp and coalescence processes of the present disclosure.

Core-Shell Structure

In some embodiments, after aggregation, but prior to coalescence, a resin coating may be applied to the aggregated particles to form a shell thereover in order to achieve particles having a core-shell structure with an approximate predetermined particle size. In embodiments, such particles having a core-shell structure may be subject to the continuous ramp and coalescence processes of the present disclosure in order to achieve the final toner particles. Suitable methods and resins for forming the core and shell structure are described in U.S. Patent Application Publication No. 2012/0258398, the disclosure of which is totally incorporated herein by reference.

The shell resin may be applied to the aggregated particles by any suitable method. In embodiments, the resins utilized to form the shell may be in an emulsion including any known surfactants. The emulsion possessing the resins may be combined with the aggregated particles described above so that the shell forms over the aggregated particles, such as aggregated particles having a particle size that is about equal to the initial predetermined desired particle size. In embodiments, the shell may have a thickness of up to about 5 microns, or of from about 0.1 microns to about 2 microns, in other embodiments, from about 0.3 microns to about 0.8 microns, over the formed aggregates.

The formation of the shell over the aggregated particles may occur while heating to a temperature of from about 30° C. to about 80° C., or from about 35° C. to about 70° C. The formation of the shell may take place for a period of time of from about 5 minutes to about 10 hours, in embodiments from about 10 minutes to about 5 hours.

Freezing Aggregation

In some embodiments, once the desired size of the particles to be acted on by the continuous ramp and coalescence processes of the present disclosure is achieved, the pH of the mixture may be adjusted with a base to a value of from about 3 to about 10, or from about 5 to about 9. The adjustment of the pH may be utilized to freeze, that is to stop, toner growth. The base utilized to stop toner growth may include any suitable base such as, for example, alkali metal hydroxides such as, for example, sodium hydroxide, potassium hydroxide, ammonium hydroxide, combinations thereof, and the like. In embodiments, ethylene diamine tetraacetic acid (EDTA) may be added to help adjust the pH to the desired values noted above.

In embodiments, before the slurry is heated to a coalescence temperature, the temperature of the slurry may reach a predetermined pH adjustment temperature and the pH of the slurry may be reduced to a predetermined coalescence pH by adding an aqueous acid solution, such as $HNO_3$. Adjusting the pH to a predetermined coalescence pH may increase spheroidization and preserve particle size distribution by controlling circularity based on pH at high temperatures. Examples of these processes include those disclosed, for example, in U.S. Patent Application Publication No. 2011/0318685 to Vanbesien et al., the disclosure of which is totally incorporated herein by reference.

Coalescence

According to the methods of the present disclosure, the coalescence step may be carried out by continuously passing a frozen and/or aggregated toner slurry through at least one heat exchanger, where the at least one heat exchanger has been heated to a temperature suitable for coalescence. For example, in embodiments, the at least one heat exchanger may be heated to a temperature of from about 100° C. to about 150° C., such as from about 110° C. to about 145° C., or from about 120° C. to about 140° C.

Because the at least one heat exchanger may be heated to a temperature greater than the boiling point of water at atmospheric pressure, the system may be pressurized, such as to a pressure that is sufficient (at the temperature selected for the heat exchanger) to avoid boiling the water component of the toner slurry. Atmospheric pressure refers, for example, to a pressure of about 760 torr, or 1 atmosphere (atm). The term "pressurized" refers, for example, to a pressure of the heat exchanger system that is greater than atmospheric pressure, such as a pressure greater than about 1 atm, or greater than about 1.5 atm, or greater than about 2 atm.

In embodiments, the pressure may be maintained at any desired pressure, such as a pressure greater than the vapor pressure of water. In contrast to a coalescence step of a typical batch process, where the temperature is kept below the boiling point of water at atmospheric pressure (such as less than about 96° C.) so as to avoid evaporating the water component of the toner slurry and boiling off the water present in the batch reactor, the system according to the instant disclosure may be pressurized, and thus the temperature may be increased to temperatures above the atmospheric boiling point of water with minimal or no loss of water due to boiling of the water component of the toner slurry. For example, in embodiments, the system may be pressurized when the at least one heat exchanger is heated to a temperature of from about 100° C. to about 150° C., such as from about 120° C. to about 145° C., or from about 130° C. to about 140° C. Thus, in the processes of the present disclosure, the coalescence process to achieve the final toner-particle shape and morphology may be carried out at higher temperatures than typical batch processes.

As a result of these higher temperatures, the rate of spheroidization (coalescence) may be increased such that coalescence may be completed within a residence time on the order of minutes. For example, coalescence may be completed with a residence time at temperature of from about 1 second to about 15 minutes, such as from about 10 seconds to about 10 minutes, or from about 15 seconds to about 5 minutes, or from about 30 seconds to about 2 minutes. As used herein, "residence time at temperature" refers to the time the toner slurry spends at a target temperature, such as a temperature suitable for coalescence, after the toner slurry has been heated to the target temperature within a heat exchanger. In embodiments, the residence time at temperature may be different from the time the toner slurry spends within the heat exchanger. For example, in embodiments, the toner slurry may be heated to temperature within a heat exchanger, and then coalescence may be completed by flowing the slurry through an insulated length of tubing such that the temperature drop is minimized, and for a residence time of from about 1 second to about 15 minutes, such as from about 10 seconds to about 5 minutes, or from about 30 seconds to about 2 minutes. In embodiments, the toner slurry may reach temperature at the outlet of the heat exchanger. In embodiments, the toner slurry may reach temperature within the body of the heat exchanger.

Because the target spheroidization may be met by passing the frozen and/or aggregated toner slurry through the at least one heat exchanger with a residence time on the order of minutes, the throughput of the system may be dependent only on the size and temperature of the heat exchangers in the system. In contrast, batch processes are much longer, typically requiring hours (sometimes more than 10 hours) for the particles to reach the target spheroidization.

In embodiments, the frozen and/or aggregated toner slurry may be preheated, such as to a temperature greater than the glass transition temperature (Tg) of the resin, before the toner slurry is heated to coalescence temperature in the at least one heat exchanger. The temperature of the preheating may be greater than the glass transition temperature of the resin, but less than the coalescence temperature. For example, in embodiments, the temperature of the preheating may be at a temperature of from about 5° C. to about 30° C. greater than the glass transition temperature of the resin, such as from about 7.5° C. to about 25° C. greater than the glass transition temperature of the resin, or from about 10° C. to about 20° C. greater than the glass transition temperature of the resin. In some embodiments, the temperature of the preheating may be a temperature of from about ($T_g$+5° C.) to about ($T_g$+30° C.), such as from about ($T_g$+7.5° C.) to about ($T_g$+25° C.), or from about ($T_g$+10° C.) to about ($T_g$+20° C.). For example, the toner slurry may be heated to a temperature greater than about 60° C., such as from about 60° C. to about 110° C., or from about 63° C. to about 85° C., or from about 65° C. to about 75° C. In embodiments, for example, the toner slurry may be preheated to about 65° C.

In embodiments, the frozen and/or aggregated toner slurry may be preheated to a temperature greater than the glass transition temperature of the resin before the toner slurry is added to the heat exchanger system. For example, the toner slurry may be preheated to a temperature greater than the glass transition temperature of the resin as a batch process in the aggregation vessel, or in a second vessel, before introducing the toner slurry to the heat exchanger system to continuously coalesce the particles. Pre-heating the slurry in the aggregation vessel prior to adding the slurry to the heat exchanger system eliminates the need for an additional piece of reaction equipment to carry out the preheating step.

By heating the toner slurry to a temperature greater than the glass transition temperature of the resin before introducing the toner slurry to the heat exchanger system, the continuous coalescence process does not produce any fines, which prevents a change in the geometric size distribution (GSD) of the toner. The term "fines" refers, for example, to toner particles having less than about 3 μm volume median diameter. Without being limited to a particular theory, by heating the slurry beyond the glass transition temperature of the resin, the weakly aggregated toner particles may fuse together, making them more robust against temperature shock from the rate of heating in the heat exchanger. Thus, when the slurry is heated to a temperature greater than the glass transition temperature of the resin in a batch process before the slurry is introduced into the heat exchanger system to continuously coalesce the particles, the system produces zero fines.

The preheated toner slurry may be introduced to the heat exchanger system immediately after it is heated to a temperature greater than the glass transition temperature of the resin, or it may be cooled and/or stored before being introduced into the heat exchanger system. Once the toner slurry, such as a frozen and aggregated toner slurry, has been preheated, it may be added to the heat exchanger system at a temperature greater or less than the glass transition temperature of the resin. In other words, if the toner slurry, such as a frozen and aggregated toner slurry, has once been preheated to a temperature greater than the glass transition temperature of the resin, the toner slurry may be introduced to the heat exchanger system at a temperature less than the glass transition temperature of the resin without the generation of fines—that is, a toner slurry that has been cooled need not be reheated before being introduced into the heat exchanger system to avoid the generation of fines.

In embodiments, the toner slurry may be preheated, such as to a temperature greater than the glass transition temperature of the resin, after being introduced to the heat exchanger system. In other words, the frozen and/or aggregated toner slurry may be preheated by passing the toner slurry through at least one heat exchanger heated to a temperature greater than the glass transition temperature of the resin but less than the coalescence temperature. For example, in embodiments, the toner slurry may be passed through a heat exchanger system comprising at least two heat exchangers, where the first heat exchanger and the second heat exchanger are heated to different temperatures.

In embodiments, the first heat exchanger may be heated to a temperature greater than the glass transition temperature of the resin, but less than the coalescence temperature, to preheat the toner slurry to a temperature greater than the Tg of the resin. In embodiments, the first heat exchanger may be heated to a temperature of from about ($T_g$+5° C.) to about ($T_g$+30° C.), such as from about ($T_g$+7.5° C.) to about ($T_g$+25° C.), or from about ($T_g$+10° C.) to about ($T_g$+20° C.). For example, the first heat exchanger may be heated to a temperature of greater than about 60° C., such as from about 60° C. to about 110° C., or from about 63° C. to about 100° C., or from about 65° C. to about 75° C. The second heat exchanger may be heated to a temperature suitable for coalescence. For example, in embodiments, the second heat exchanger may be heated to a temperature of from about 100° C. to about 150° C., such as from about 110° C. to about 145° C., or from about 120° C. to about 140° C. The first heat exchanger preheats the toner slurry to a temperature greater than the glass transition temperature of the resin, which prevents the large generation of fines.

In embodiments, the step of preheating the toner slurry may serve to decrease temperature shock on the slurry when it passes through the second (higher temperature) heat exchanger. Preheating in the first heat exchanger may also allow for some partial coalescence in the first heat exchanger. In embodiments this partial coalescence in the first heat exchanger may represent 2% to 20% of the coalescence process, or 5% to 15% of the coalescence process. For example, in embodiments, the partial coalescence in the first heat exchanger may result in the particles that may have a mean circularity of from about 0.88 to about 0.94, such as from about 0.89 to about 0.93, or from about 0.90 to about 0.93. Such particles may then be further processed in subsequent heat exchangers to obtain the toner particles having a mean circularity of from about 0.930 to about 0.990, such as from about 0.940 to about 0.985, or from about 0.945 to about 0.980. This initial fusing may yield more robust toner particles after the particles pass through the higher-temperature heat exchanger, thereby preventing the large generation of fines.

The toner slurry may be passed through more than one heat exchanger during the ramp and coalescence process. For example, the toner slurry may be passed through at least two heat exchangers. In embodiments, the two heat exchangers may be heated to different temperatures. In embodiments, a first heat exchanger may be at a lower temperature than a second heat exchanger, such as in the preheating step discussed above. In embodiments, the toner may pass through at least two heat exchangers, where a first heat exchanger may be at a higher temperature than a second heat exchanger. For example, in embodiments, the first heat exchanger may be heated to a temperature of from about 100° C. to about 150° C., such as from about 110° C. to about 145° C., or from about 120° C. to about 140° C. The second heat exchanger may be at a lower temperature than the first heat exchanger, such that the second heat exchanger quenches the temperature of the toner slurry after it exits the higher temperature heat exchanger. In embodiments, the second heat exchanger may reduce the temperature of the toner slurry to a temperature suitable for pH adjustment. For example, the second heat exchanger may reduce the temperature of the toner slurry in a range of from about 40° C. to about 90° C. below the coalescence temperature, such as from about 45° C. to about 80° C. lower than the coalescence temperature, or from about 50° C. to about 70° C. lower than the coalescence temperature. In embodiments, the temperature may be quenched to a temperature suitable for discharge, which in embodiments may be a temperature lower than the glass transition temperature (Tg) of the toner.

In embodiments, the toner slurry may be passed through more than one heat exchanger maintained at the same temperature. For example, two or more heat exchangers may be connected in series and heated to the same temperature on the shell side of the heat exchangers, such as with the same heating utility, such that the two or more heat exchangers may function as a single, longer heat exchanger.

In a heat exchanger system comprising at least one heat exchanger, the residence time within any single heat exchanger may be from about 0.1 minute to about 30 minutes, such as from about 1 minute to about 15 minutes, or from about 3 minutes to about 10 minutes. The total residence time of the toner in a heat exchanger system comprising at least one heat exchanger is the sum of the residence times of the individual heat exchangers in the system. Thus, the total residence time of the toner in the heat exchanger system depends on the number of heat exchangers in the system, and the temperature of each heat exchanger.

An exemplary embodiment of the present disclosure is shown in FIG. 1, which illustrates how four heat exchangers may be connected to ramp, coalesce, and cool toner particles. In FIG. 1, four heat exchangers—a first heat exchanger 10, a second heat exchanger 20, a third heat exchanger 30, and a fourth heat exchanger 40—may be used to ramp a toner slurry, such as a frozen and aggregated toner slurry, to a coalescence temperature, coalesce the particles, and then cool the particles. Pressure may be maintained by a back pressure regulator (not pictured) located, for example, between the second heat exchanger 20 and the third heat exchanger 30, before optionally at least one static mixer (not pictured), also located between the second heat exchanger 20 and the third heat exchanger 30.

In embodiments, such as that illustrated in FIG. 1, the first heat exchanger 10 may be heated to a temperature of from about 100° C. to about 115° C., such as from about 103° C. to about 110° C., or from about 105° C. to about 108° C., using, for example, a warm bath flowed along path P-6, over heat exchanger 10, to path P-7. The second heat exchanger 20 may be heated to a temperature of from about 115° C. to about 150° C., such as from about 120° C. to about 145° C., or from about 130° C. to about 140° C. (for example, by a heated bath flowed from path P-8, over heat exchanger 20, to path P-9), so that the toner particles can reach a desired coalescence temperature.

In embodiments, the first heat exchanger 10 may be heated to a temperature greater than the glass transition temperature of the resin, and the second heat exchanger 20 may be heated to a temperature suitable for coalescence.

In embodiments, a cool bath, such as a domestic chilled water bath, may be used to maintain the third heat exchanger 30 at a temperature lower than the second heat exchanger 20, such as from about 40° C. to about 90° C., or from about 50° C. to about 80° C., or from about 60° C. to about 70° C. (for example, by flowing the cool bath from path P-10, over heat exchanger 30, to path P-11). The toner particles may thus be cooled by passing through the third heat exchanger 30 after passing through the second heat exchanger 20 (that is, passing from path P-3 to path P-4 via heat exchanger 30). The particles may be cooled, for instance, to a temperature suitable for pH adjustment. To adjust the pH, an aqueous base solution, such as NaOH, may be fed into the toner slurry, such as after the second heat exchanger 20 between the back pressure regulator and at least one static mixer. The at least one static mixer may then mix the aqueous base solution into the slurry before the slurry enters the fourth heat exchanger 40, where it may be cooled to a temperature suitable for discharge, such as a temperature lower than the Tg of the toner, before the toner slurry exits through path P-5. The temperature of heat exchanger 40 may be maintained by flowing a bath from path P-12, over heat exchanger 40, to path P-13.

Additionally, in embodiments, a system of heat exchangers may be connected in such a way that energy may be recovered from the ramp and coalescence step, thereby yielding greater energy efficiency in the process. For example, in embodiments, the system may comprise at least three heat exchangers, wherein the first and third heat exchangers are connected in a closed loop, and the second heat exchanger may be heated to a temperature suitable for coalescence. The first heat exchanger may preheat the incoming toner slurry prior to the slurry passing through the second (higher temperature) heat exchanger, and the third heat exchanger may cool the toner slurry after it passes through the second (higher temperature) heat exchanger. For example, in embodiments, the first heat exchanger may increase the temperature of the toner slurry from its initial temperature to a temperature of from about 51° C. to about 95° C., such as from about 51° C. to about 85° C., or from about 60° C. to about 79° C. The second heat exchanger may be heated to a temperature of from about 100° C. to about 150° C., such as from about 110° C. to about 145° C., or from about 120° C. to about 140° C. The third heat exchanger, which may be connected in a closed loop with the first heat exchanger, may cool the toner slurry to a temperature of from about 60° C. to about 100° C., such as from about 70° C. to about 90° C., or from about 75° C. to about 85° C., after the toner slurry exits the second heat exchanger. In embodiments where the first and third heat exchangers are connected in a closed loop, energy that is input into the system to heat the toner slurry may be recovered.

In embodiments, the process steps of the continuous process for coalescing particles may include heating at least one heat exchanger to a temperature suitable for coalescence, and passing the toner slurry, such as a frozen and aggregated toner slurry, through the at least one heat exchanger to coalesce the particles. In embodiments, the system is pressurized, such that an average pressure may be maintained, for example, at value greater than the vapor pressure of water. In such a pressurized system, the temperature may be increased to temperatures above the atmospheric boiling point of water without boiling the water component of the toner slurry.

For example, in embodiments, the at least one heat exchanger may be heated to a temperature of from about 100° C. to about 150° C., such as from about 110° C. to about 145° C., or from about 120° C. to about 140° C. In embodiments, the methods of the present disclosure may include a heat exchanger system where one or more parts of the system, or the entire system, may be pressurized. For example, the pressure of one or more of the heat exchangers of the system and/or the entire system may be maintained at a pressure greater than the vapor pressure of water. In embodiments, the pressure of one or more of the heat exchangers of the system and/or the entire system may be maintained at a predetermined temperature and pressure where the pressure may be from about 1% to about 800% greater than the vapor pressure of water (at the predetermined temperature), such as from about 1% to about 20% greater, or from about 5% to about 10% greater, or from about 10% to about 30% greater than the vapor pressure of water (at the predetermined temperature), or from about 15% to about 25% greater than the vapor pressure of water (at the predetermined temperature). In embodiments, for a given temperature, the pressure of one or more of the heat exchangers of the system and/or the entire system may be about 10% greater than the vapor pressure of water.

In embodiments, the temperature and pressure of the one or more of the heat exchangers of the system and/or the entire system are set to prevent the water component of the toner slurry from boiling. For example, at elevated pressures above one atm, one or more of the heat exchangers of the system and/or the entire system may be heated to temperatures above the boiling point of water at atmospheric pressure (for example above about 100° C., or in a range of from about 100° C. to about 200° C.). Because one or more of the heat exchangers of the system and/or the entire system is pressurized, the toner slurry may be heated to temperatures above the atmospheric boiling point of water without boiling the water component of the toner slurry. In embodiments, the pressure of the system may be maintained at a predetermined pressure by a back pressure regulator, a peristaltic pump, a gear pump, or a progressive cavity pump. In embodiments, the system may maintain a predetermined pressure by discharging through a back-pressure regulating diaphragm valve, which allows for discharge to the atmosphere.

In the methods of the present disclosure the slurry may ramped to a predetermined coalescence temperature, and the temperature of the slurry may be maintained at that temperature that allows the particles to coalesce. In embodiments, high temperatures, such as from about 100° C. to about 150° C., or from about 110° C. to about 145° C., or from about 120° C. to about 140° C., may be used in one or more of the pressurized heat exchangers of the system to increase the rate of spheroidization such that coalescence may be completed within a residence time on the order of minutes. For example, residence time of the slurry from about 1 second to about 15 minutes, such as from about 15 seconds to about 5 minutes, or from about 30 seconds to about 2 minutes in one or more of the pressurized high-temperature heat exchangers of the system of the present disclosure may be sufficient to achieve the desired coalescence and target spheroidization. In embodiments, a residence time of the slurry in one or more of the pressurized high-temperature heat exchangers of the system of the present disclosure of less than about 2 minutes may be sufficient to achieve the desired coalescence and target spheroidization.

Because the target spheroidization may be met by passing toner slurry, such as a frozen and aggregated toner slurry, through the at least one heat exchanger with a residence time on the order of minutes, throughput of the system is dependent only on the size and temperature of the heat exchanger. In embodiments, coalescence may take place entirely within one or more heat exchanger(s); that is to say, the toner slurry, such as a frozen and aggregated toner slurry, is continuously added to the one or more heat exchanger(s), and fully coalesced particles having a target degree of spheroidization may be recovered continuously from the one or more heat exchanger(s).

The coalesced particles may be measured periodically for circularity, such as with a Sysmex FPIA 2100 analyzer, where circularity of the particle may be described by the following formula:

$$\text{Circularity} = \frac{\text{Circularity of a circle having the same area as the particle}}{\text{Perimeter of the particle}}$$

A circularity of 1.000 indicates a completely circular sphere. In embodiments, the toner particles produced by the method of the present disclosure may have a mean circularity of from about 0.930 to about 0.990, such as from about 0.940 to about 0.985, or from about 0.945 to about 0.980. In embodiments, the target mean circularity may be reached with a residence time at temperature of from about 1 second to about 15 minutes, such as from about 10 seconds to about 10 minutes, or from about 15 seconds to about 5 minutes, or from about 30 seconds to about 2 minutes.

In embodiments, the at least one heat exchanger is a standard shell-tube heat exchanger. In embodiments, the shell-side of the heat exchanger may be exposed to a bath having a desired temperature, so as to heat or cool the heat exchanger to the desired temperature. For example, in embodiments, the bath may be a heated bath to increase the temperature of the at least one heat exchanger. In embodiments, the bath is an oil bath, such as a glycol bath or a glycol/water mixture bath.

In embodiments, a single heat exchanger may be used to conduct the coalescence step. In further embodiments, the toner slurry may be passed through more than one heat exchanger during the ramp and coalescence process. For example, in embodiments, the toner slurry may be passed through at least two heat exchangers.

For example, in embodiments, the slurry may be passed through at least one heat exchanger to ramp and coalesce the particles at a desired coalescence temperature, as described above, and then the slurry may be passed through at least one additional heat exchanger to quench the temperature of the slurry after coalescence. After coalescence, the mixture may be cooled to room temperature, such as a temperature from about 20° C. to about 25° C. The cooling may be rapid or slow, as desired. A suitable cooling method may include introducing cold water to a jacket around at least one additional heat exchanger to quench. After cooling, the toner particles may be optionally washed with water, and then dried. Drying may be accomplished by any suitable method for drying including, for example, freeze-drying.

The cooling process may include an additional pH adjustment at a predetermined cooling pH temperature. For example, in embodiments, at least one additional heat exchanger may quench the temperature of the toner slurry from the coalescence temperature to a pH adjustment temperature. The predetermined cooling pH adjustment temperature may be in a range of from about 40° C. to about 90° C. below the predetermined coalescence temperature, such as from about 45° C. to about 80° C., or from about 50° C. to about 70° C. below the predetermined coalescence temperature. The pH of the slurry may be adjusted to a predetermined cooling pH of from about 7.0 to about 10, such as from about 7.5 to about 9.5, or from about 8.0 to about 9.0. This may be done by adding an aqueous base solution, such as, for example, NaOH. The temperature of the slurry may be maintained at the predetermined cooling pH adjustment temperature for any time period, such as a time period of from about 0 minutes to about 60 minutes, or about 5 to about 30 minutes, followed by cooling to room temperature. In embodiments, the system may further contain at least one additional heat exchanger to further quench the temperature of the toner slurry from the pH adjustment temperature to a temperature suitable for discharge, such as room temperature.

The ramp and coalescence process may also be carried out in more than one heat exchanger. For example, the toner slurry may be passed through at least two heat exchangers. The first of the at least two heat exchangers may be maintained at a lower temperature than the second of the at least two heat exchangers. For example, the first heat exchanger may be heated to a temperature of from about 100° C. to about 115° C., such as from about 103° C. to about 110° C., or from about 105° C. to about 108° C. Accordingly, when the toner slurry, such as a frozen and aggregated toner slurry, is passed through this first heat exchanger, the first heat exchanger may increase the temperature of the toner slurry from its initial temperature (in embodiments, about 50° C.) to a temperature of from about 85° C. to about 110° C., such as from about 90° C. to about 100° C., or from about 92° C. to about 97° C. The second of the at least two heat exchangers may be heated to a temperature greater than that of the first heat exchanger. For example, the second heat exchanger may be heated to a temperature of from about 115° C. to about 150° C., such as from about 120° C. to about 145° C., or from about 130° C. to about 140° C.

In embodiments, the lower temperature heat exchanger may preheat the toner slurry before it reaches the second heat exchanger, which decreases the temperature shock on the incoming slurry when it passes through the higher temperature heat exchanger. Further, by heating the slurry from an initial temperature (such as about 51° C.) to the predetermined coalescence temperature (for example, about 130° C.) in two heat exchangers, the rate of temperature increase (° C./min) may be decreased as desired, such as decreasing the rate of temperature increase (° C./min) by half. Passing the toner slurry through the lower temperature heat exchanger before passing through the higher temperature heat exchanger also allows for some partial coalescence (partial aggregate fusing) in the first heat exchanger. This initial fusing yields more robust final toner particles after the toner slurry has passed through the second heat exchanger, thereby preventing the large generation of fines.

In embodiments, in addition to the above-described at least two heat exchangers, the system may contain at least one additional heat exchanger to quench the temperature of the toner slurry after it exits the second (higher temperature) heat exchanger. In embodiments, at least one heat exchanger may quench the temperature of the toner slurry from the coalescence temperature to a pH adjustment temperature. The at least one heat exchanger may reduce the temperature in a range of from about 40° C. to about 90° C. below the coalescence temperature, such as from about 45° C. to about 80° C., or from about 50° C. to about 70° C. below the coalescence temperature. The pH may then be adjusted by adding an aqueous base solution, such as, for example, NaOH. In embodiments, the pH may be adjusted in line. In embodiments, the system may further contain at least one additional heat exchanger to further quench the temperature of the toner slurry from the pH adjustment temperature to a temperature suitable for discharge. In embodiments, a temperature suitable for discharge is a temperature lower than the glass transition temperature (Tg) of the toner.

In embodiments, the total residence time of the toner slurry in each heat exchanger is from about 1 second to about 15 minutes, such as from about 10 seconds to about 10 minutes, or from about 15 seconds to about 5 minutes, or from about 30 seconds to about 2 minutes.

In embodiments, the method may include passing toner slurry, such as a frozen and aggregated toner slurry, through at least three heat exchangers, wherein at least two heat exchangers are connected to recover energy from the ramp and coalescence process. For example, in embodiments, toner slurry, such as a frozen and aggregated toner slurry, may be passed through at least three heat exchangers, wherein the first and third heat exchangers are connected in a closed loop, and the second heat exchanger is heated to a temperature suitable for coalescence. In embodiments, the second heat exchanger may be heated to a temperature of from about 115° C. to about 150° C., such as from about 120° C. to about 145° C., or from about 130° C. to about 140° C. The third heat exchanger may cool the toner slurry after coalescence and recover heat energy added to the toner slurry in the second heat exchanger. Because the first and third heat exchangers are connected in a closed loop, this recovered heat energy can be used in the first heat exchanger to preheat the toner mixture before it passes through the second heat exchanger. Therefore, in embodiments, the first heat exchanger may increase the temperature of the toner slurry from its initial temperature (in embodiments, about 50° C.) to a temperature of from about 51° C. to about 99° C., such as from about 51° C. to about 85° C., or from about 60° C. to about 79° C. The second heat exchanger may then heat the toner slurry to a temperature of from about 100° C. to about 150° C., such as from about 110° C. to about 145° C., or from about 120° C. to about 140° C. The third heat exchanger may then cool the toner slurry to a temperature of from about 60° C. to about 100° C., such as from about 70° C. to about 90° C., or from about 75° C. to about 85° C. In embodiments, the system may be pressurized.

Figure 2:
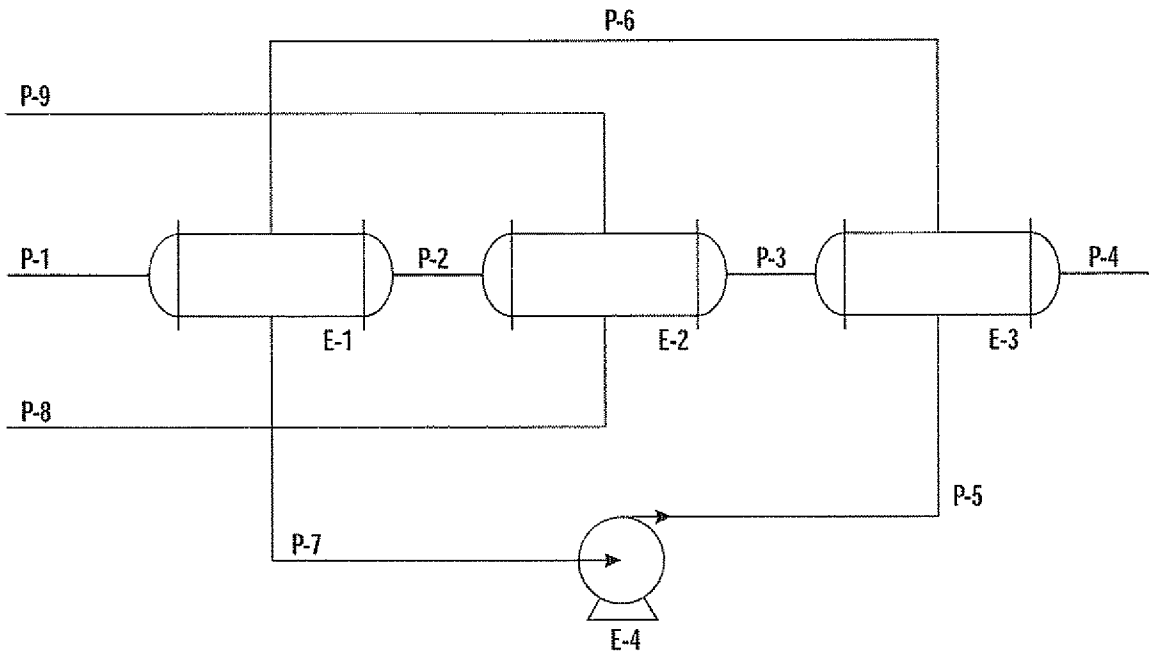
FIG. 2 illustrates an embodiment of a system for carrying out ramp/coalescence in an emulsion/aggregation process incorporating three heat exchangers, in which the first and third heat exchangers are connected in a closed loop to recover energy from the process.

FIG. 2 illustrates how three heat exchangers may be connected for energy recovery high temperature coalescence. In FIG. 2, three heat exchangers E-1, E-2, and E-3 are used to ramp a toner slurry, such as a frozen and aggregated toner slurry, to a coalescence temperature, coalesce the particles, and then to cool the slurry. The second heat exchanger E-2 is heated to a desired coalescence temperature (such as by a bath flowed from path P-8 to path P-9), while the first heat exchanger E-1 and third heat exchanger E-3 are connected in a closed loop (i.e., a bath may be flowed around heat exchanger E-3 along path P-5 to path P-6, and then around heat exchanger E-1 by passing from path P-6 to path P-7, by pump E-4) to recover heat energy from the process to reduce energy requirements in preheating the incoming slurry. For example, a bath may be heated and passed on the shell-side of the second heat exchanger E-2, while a bath may be passed on the shell-sides of the first and second heat exchangers E-1 and E-3 in a closed loop.

Because the first and third heat exchangers are connected in a closed loop, the system is able to recover a significant amount of energy which has been inputted into the system to heat the slurry to a temperature above, for example, about 120° C. The total energy input and peak energy demand are therefore greatly reduced. For example, in FIG. 2 described above, if the first heat exchanger E-1 ramped the incoming slurry from about 51° C. to temperatures above about 79° C., the second heat exchanger E-2 heated the slurry from above about 79° C. to above about 120° C., and the third heat exchanger E-3 cooled the slurry from temperatures above about 120° C. to temperatures about 80° C., because the entrance temperature of the toner slurry is about 51° C. and the exit temperature is about 80° C., the net increase in temperature is only about 29° C. In contrast, in batch processes, it is very difficult to recover energy from the ramping of toner to coalescence temperatures owing to the limitation of how efficiently energy may be stored over time scales associated with batch-batch cycles.

In producing toner particles, it is desirable to control the toner particle size and limit the amount of both fine and coarse toner particles in the toner. In embodiments, the toner particles have a very narrow particle size distribution with a lower geometric standard deviation (GSDn) by number of approximately 1.15 to approximately 1.30, such as approximately less than about 1.25. The toner particles also may have a size such that the upper geometric standard deviation (GSDv) by volume is in the range of from about 1.15 to about 1.30, such as from about 1.18 to about 1.22, or less than about 1.25.

The characteristics of the toner particles may be determined by any suitable technique and apparatus. Volume average particle diameter $D_{50}$, GSDv, and GSDn may be measured by means of a measuring instrument such as a Beckman Coulter Multisizer 3, operated in accordance with the manufacturer's instructions. The GSDv refers to the upper geometric standard deviation (GSDv) by volume (coarse level) for (D84/D50). The GSDn refers to the geometric standard deviation (GSDn) by number (fines level) for (D50/D16). The particle diameters at which a cumulative percentage of 50% of the total toner particles are attained is defined as volume D50, and the particle diameters at which a cumulative percentage of 84% are attained are defined as volume D84. These aforementioned volume average particle size distribution indexes GSDv can be expressed by using D50 and D84 in cumulative distribution, wherein the volume average particle size distribution index GSDv is expressed as (volume D84/volume D50). These aforementioned number average particle size distribution indexes GSDn can be expressed by using D50 and D16 in cumulative distribution, wherein the number average particle size distribution index GSDn is expressed as (number D50/number D16). The closer to 1.0 that the GSD value is, the less size dispersion there is among the particles.

The aforementioned GSD value for the toner particles indicates that the toner particles are made to have a narrow particle size distribution.

Suitable emulsion aggregation/coalescing processes for the preparation of toners, and which can be modified to include the ramp and coalescence processes as described in the present disclosure, are illustrated in U.S. Pat. Nos. 5,290,654, 5,278,020, 5,308,734, 5,370,963, 5,344,738, 5,403,693, 5,418,108, 5,364,729, and 5,346,797, the entire disclosures of the above-mentioned U.S. patents are totally incorporated herein by reference. Further processes, components and compositions that may be used with the processes of the present disclosure may include those described in U.S. Pat. Nos. 5,348,832; 5,405,728; 5,366,841; 5,496,676; 5,527,658; 5,585,215; 5,650,255; 5,650,256; 5,501,935; 5,723,253; 5,744,520; 5,763,133; 5,766,818; 5,747,215; 5,827,633; 5,853,944; 5,804,349; 5,840,462; 5,869,215; 5,863,698; 5,902,710; 5,910,387; 5,916,725; 5,919,595; 5,925,488; 5,977,210, 6,627,373; 6,656,657; 6,617,092; 6,638,677; 6,576,389; 6,664,017; 6,656,658; and 6,673,505 the entire disclosures of the above-mentioned U.S. patents are totally incorporated herein by reference. The appropriate components and process aspects of each of the foregoing U.S. Patents may be selected for the present process and compositions in embodiments thereof.

Resins

Any monomer suitable for preparing a latex for use in a toner may be utilized. Such latexes may be produced by conventional methods. For example, in embodiments, the toner may be produced by emulsion aggregation. Suitable monomers useful in forming a latex emulsion, and thus the resulting latex particles in the latex emulsion, include, for example, styrenes, acrylates, methacrylates, butadienes, isoprenes, acrylic acids, methacrylic acids, acrylonitriles, combinations thereof, and the like.

In embodiments, the resin of the latex may include at least one polymer, such as from about 1 to about 20 polymers, or from about 3 to about 10 polymers. Exemplary polymers include styrene acrylates, styrene butadienes, styrene methacrylates, and more specifically, polystyrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid), poly(styrene-butadiene), poly (methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), polystyrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), poly(styrene-butyl acrylate-acrylonitrile-acrylic acid), poly(styrene-butadiene), poly(styrene-isoprene), poly(styrene-butyl methacrylate), poly(styrene-butyl acrylate-acrylic acid), polystyrene-butyl methacrylate-acrylic acid), poly(butyl methacrylate-butyl acrylate), poly(butyl methacrylate-acrylic acid), poly(acrylonitrile-butyl acrylate-acrylic acid), and combinations thereof. The polymer may be block, random, or alternating copolymers.

In embodiments, a poly(styrene-butyl acrylate) may be utilized as the latex. The glass transition temperature of this latex may be from about 35° C. to about 75° C., such as from about 40° C. to about 70° C.

Surfactants

Colorants, waxes, and other additives used to form toner compositions may be in dispersions that include surfactants. Moreover, toner particles may be formed by emulsion aggregation methods where the resin and other components of the toner are placed in contact with one or more surfactants, an emulsion is formed, toner particles are aggregated, coalesced, optionally washed and dried, and recovered.

One, two, or more surfactants may be used. The surfactants may be selected from ionic surfactants and nonionic surfactants. Anionic surfactants and cationic surfactants are encompassed by the term "ionic surfactants." The surfactant may be present in an amount of from about 0.01 to about 5 wt % of the toner composition, such as from about 0.75 to about 4 wt % weight of the toner composition, or from about 1 to about 3 wt % of the toner composition.

Examples of suitable nonionic surfactants include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octyiphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenac as IGEPAL CA210™, IGEPAL CA520™, IGEPAL CA720™, IGEPAL CO-890™, IGEPAL CO-72O™, IGEPAL CO290™, IGEPAL CA210™, ANTAROX 890™, and ANTAROX 897™. Other examples of suitable nonionic surfactants include a block copolymer of polyethylene oxide and polypropylene oxide, including those commercially available as SYNPERONIC PE/F, such as SYNPERONIC PE/F 108.

Suitable anionic surfactants include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants include, DOWPAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be used.

Examples of cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, cetyl pyridinium bromide, benzalkonium chloride, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

Initiators

In embodiments initiators may be added for formation of the latex. Examples of suitable initiators include water soluble initiators, such as ammonium persulfate, sodium persulfate and potassium persulfate, and organic soluble initiators including organic peroxides and azo compounds including Vazo peroxides, such as VAZO 64™, 2-methyl 2-2'-azobis propanenitrile, VAZO 88™, 2-2'-azobis isobutyramide dehydrate, and combinations thereof. Other water-soluble initiators which may be utilized include azoamidine compounds, for example 2,2'-azobis(2-methyl-N-phenylpropionamidine)dihydrochloride, 2,2'-azobis[N-(4-chlorophenyl)-2-methylpropionamidine]di-hydrochloride, 2,2'-azobis[N-(4-hydroxyphenyl)-2-methyl-propionamidine]dihydrochloride, 2,2'-azobis[N-(4-amino-phenyl)-2-methylpropionamidine]tetrahydrochloride, 2,2'-azobis[2-methyl-N(phenylmethyl)propionamidine]dihydrochloride, 2,2'-azobis[2-methyl-N-2-propenylpropionamidine]dihydrochloride, 2,2'-azobis[N-(2-hydroxy-ethyl)-2-methylpropionamidine]dihydrochloride, 2,2'-azobis[2(5-methyl-2-imidazolin-2-yl)propane]dihydrochloride, 2,2'-azobis[2-(2-imidazolin-2-yl)propane]dihydrochloride, 2,2'-azobis[2-(4,5,6,7-tetrahydro-1H-1,3-diazepin-2-yl)propane] dihydrochloride, 2,2'-azobis[2-(3,4,5,6-tetrahydropyrimidin-2-yl)propane]dihydrochloride, 2,2'-azobis[2-(5-hydroxy-3,4,5,6-tetrahydropyrimidin-2-yl) propane]di-hydrochloride, 2,2'-azobis {2-[1-(2-hydroxyethyl)-2-imidazolin-2-yl]propane}dihydrochloride, combinations thereof, and the like.

Initiators may be added in suitable amounts, such as from about 0.1 to about 8 weight percent, or from about 0.2 to about 5 weight percent of the monomers.

Chain Transfer Agents

In embodiments, chain transfer agents may also be utilized in forming the latex. Suitable chain transfer agents include, for example, dodecane thiol, octane thiol, carbon tetrabromide, combinations thereof, and the like. Where utilized, chain transfer agents may be present in amounts from about 0.1 to about 10 percent, such as from about 0.2 to about 5 percent by weight of monomers, to control the molecular weight properties of the polymer when emulsion polymerization is conducted in accordance with the present disclosure.

Stabilizers

In embodiments, a stabilizer may be used in forming the latex. Suitable stabilizers include monomers having carboxylic acid functionality. Such stabilizers may be of the following formula (I):

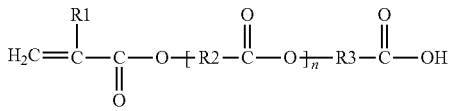

(I)

where R1 is hydrogen or a methyl group; R2 and R3 are independently selected from alkyl groups containing from about 1 to about 12 carbon atoms or a phenyl group; n is from about 0 to about 20, in embodiments from about 1 to about 10. Examples of such stabilizers include beta carboxyethyl acrylate (β-CEA), poly(2-carboxyethyl)acrylate, 2-carboxyethyl methacrylate, combinations thereof, and the like. Other stabilizers which may be utilized include, for example, acrylic acid and its derivatives.

In embodiments, the stabilizer having carboxylic acid functionality may also contain a small amount of metallic ions, such as sodium, potassium and/or calcium, to achieve better emulsion polymerization results. The metallic ions may be present in an amount from about 0.001 to about 10 percent by weight of the stabilizer having carboxylic acid functionality, such as from about 0.5 to about 5 percent by weight of the stabilizer having carboxylic acid functionality.

Where present, the stabilizer may be added in amounts from about 0.01 to about 5 percent by weight of the toner, such as from about 0.05 to about 2 percent by weight of the toner.

Additional stabilizers that may be utilized in the toner formulation processes include bases such as metal hydroxides, including sodium hydroxide, potassium hydroxide, ammonium hydroxide, and optionally combinations thereof. Also useful as a stabilizer is sodium carbonate, sodium bicarbonate, calcium carbonate, potassium carbonate, ammonium carbonate, combinations thereof, and the like. In embodiments a stabilizer may include a composition containing sodium silicate dissolved in sodium hydroxide.

pH Adjustment Agent

In embodiments, a pH adjustment agent may be added to control the rate of the emulsion aggregation process. The pH adjustment agent utilized in the processes of the present disclosure can be any acid or base that does not adversely affect the products being produced. Suitable bases can include metal hydroxides, such as sodium hydroxide, potassium hydroxide, ammonium hydroxide, and optionally combinations thereof. Suitable acids include nitric acid, sulfuric acid, hydrochloric acid, citric acid, acetic acid, and optionally combinations thereof.

Waxes

The resin emulsion may be prepared to include a wax. In these embodiments, the emulsion will include resin and wax particles at the desired loading levels, which allows for a single resin and wax emulsion to be made rather than separate resin and wax emulsions. Further, the combined emulsion allows for reduction in the amount of surfactant needed to prepare separate emulsions for incorporation into toner compositions. This is particularly helpful in instances where it would otherwise be difficult to incorporate the wax into the emulsion. However, the wax can also be separately emulsified, such as with a resin, and separately incorporated into final products.

In addition to the polymer binder resin, the toners may also contain a wax, either a single type of wax or a mixture of two or more different waxes. A single wax can be added to toner formulations, for example, to improve particular toner properties, such as toner particle shape, presence and amount of wax on the toner particle surface, charging and/or fusing characteristics, gloss, stripping, offset properties, and the like. Alternatively, a combination of waxes may be added to provide multiple properties to the toner composition.

Examples of suitable waxes include waxes selected from natural vegetable waxes, natural animal waxes, mineral waxes, synthetic waxes, and functionalized waxes. Natural vegetable waxes include, for example, carnauba wax, candelilla wax, rice wax, sumacs wax, jojoba oil, Japan wax, and bayberry wax. Examples of natural animal waxes include, for example, beeswax, panic wax, lanolin, lac wax, shellac wax, and spermaceti wax. Mineral-based waxes include, for example, paraffin wax, microcrystalline wax, montan wax, ozokerite wax, ceresin wax, petrolatum wax, and petroleum wax. Synthetic waxes include, for example, Fischer-Tropsch wax; acrylate wax; fatty acid amide wax; silicone wax; polytetrafluoroethylene wax; polyethylene wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, diglyceryl distearate, dipropyleneglycol distearate, and triglyceryl tetrastearate; sorbitan higher fatty acid ester waxes, such as sorbitan monostearate; and cholesterol higher fatty acid ester waxes, such as cholesteryl stearate; polypropylene wax; and mixtures thereof.

In some embodiments, the wax may be selected from polypropylenes and polyethylenes commercially available from Allied Chemical and Baker Petrolite (for example POLYWAX™ polyethylene waxes from Baker Petrolite), wax emulsions available from Michelman Inc. and the Daniels Products Company, EPOLENE N-15 commercially available from Eastman Chemical Products, Inc., VISCOL 550-P, a low weight average molecular weight polypropylene available from Sanyo Kasei K. K., and similar materials. The commercially available polyethylenes usually possess a molecular weight (Mw) of from about 500 to about 2,000, such as from about 1,000 to about 1,500, while the commercially available polypropylenes used have a molecular weight of from about 1,000 to about 10,000. Examples of functionalized waxes include amines, amides, imides, esters, quaternary amines, carboxylic acids or acrylic polymer emulsion, for example, JONCRYL 74, 89, 130, 537, and 538, all available from Johnson Diversey, Inc., and chlorinated polyethylenes and polypropylenes commercially available from Allied Chemical and Petrolite Corporation and Johnson Diversey, Inc. The polyethylene and polypropylene compositions may be selected from those illustrated in British Pat. No. 1,442,835, the entire disclosure of which is incorporated herein by reference.

The toners may contain the wax in any amount of from, for example, about 1 to about 25 wt % of the toner, such as from about 3 to about 15 wt % of the toner, on a dry basis; or from about 5 to about 20 wt % of the toner, or from about 5 to about 11 wt % of the toner.

Colorants

The toners may also contain at least one colorant. Colorants or pigments include pigments, dyes, mixtures of pigment and dye, mixtures of pigments, mixtures of dyes, and the like. "Colorant" refers, for example, to such colorants, dyes, pigments, and mixtures, unless specified as a particular pigment or other colorant component. The colorant may comprise a pigment, a dye, mixtures thereof, carbon black, magnetite, black, cyan, magenta, yellow, red, green, blue, brown, and mixtures thereof, in an amount of about 0.1 to about 35 wt % based upon the total weight of the composition, such as from about 1 to about 25 wt %.

In general, suitable colorants include Paliogen Violet 5100 and 5890 (BASF), Normandy Magenta RD-2400 (Paul Uhlrich), Permanent Violet VT2645 (Paul Uhlrich), Heliogen Green L8730 (BASF), Argyle Green XP-1,1-S (Paul Uhlrich), Brilliant Green Toner GR 0991 (Paul Uhlrich), Lithol Scarlet D3700 (BASF), Toluidine Red (Aldrich), Scarlet for Thermoplast NSD Red (Aldrich), Lithol Rubine Toner (Paul Uhlrich), Lithol Scarlet 4440, NBD 3700 (BASF), Bon Red C (Dominion Color), Royal Brilliant Red RD-8192 (Paul Uhlrich), Oracet Pink RF (Ciba Geigy), Paliogen Red 3340 and 3871K (BASF), Lithol Fast Scarlet L4300 (BASF), Heliogen Blue D6840, D7080, K7090, K6910 and L7020 (BASF), Sudan Blue OS (BASF), Neopen Blue FF4012 (BASF), PV Fast Blue B2G01 (American Hoechst), Irgalite Blue BCA (Ciba Geigy), Paliogen Blue 6470 (BASF), Sudan II, III and IV (Matheson, Coleman, Bell), Sudan Orange (Aldrich), Sudan Orange 220 (BASF), Paliogen Orange 3040 (BASF), Ortho Orange OR 2673 (Paul Uhlrich), Paliogen Yellow 152 and 1560 (BASF), Lithol Fast Yellow 0991K (BASF), Paliotol Yellow 1840 (BASF), Novaperm Yellow FGL (Hoechst), Permanent Yellow YE 0305 (Paul Uhlrich), Lumogen Yellow D0790 (BASF), Suco-Gelb 1250 (BASF), Suco-Yellow D1355 (BASF), Suco Fast Yellow D1165, D1355 and D1351 (BASF), Hostaperm Pink E (Hoechst), Fanal Pink D4830 (BASF), Cinquasia Magenta (DuPont), Paliogen Black L9984 9BASF), Pigment Black K801 (BASF), and carbon blacks such as REGAL 330 (Cabot), Carbon Black 5250 and 5750 (Columbian Chemicals), and the like, and mixtures thereof.

Additional colorants include pigments in water-based dispersions such as those commercially available from Sun Chemical, for example SUNSPERSE BHD 6011 X (Blue 15 Type), SUNSPERSE BHD 9312X (Pigment Blue 15 74160), SUNSPERSE BHD 6000X (Pigment Blue 15:3 74160), SUNSPERSE GHD 9600X and GHD 6004X (Pigment Green 7 74260), SUNSPERSE QHD 6040X (Pigment Red 12273915), SUNSPERSE RHD 9668X (Pigment Red 185 12516), SUNSPERSE RHD 9365X and 9504X (Pigment Red 57 15850:1, SUNSPERSE YHD 6005X (Pigment Yellow 83 21108), FLEXIVERSE YFD 4249 (Pigment Yellow 17 21105), SUNSPERSE YHD 6020X and 6045X (Pigment Yellow 74 11741), SUNSPERSE YHD 600X and 9604X (Pigment Yellow 14 21095), FLEXIVERSE LFD 4343 and LFD 9736 (Pigment Black 7 77226), and the like, and mixtures thereof. Other water based colorant dispersions include those commercially available from Clariant, for example, HOSTAFINE Yellow GR, HOSTAFINE Black T and Black TS, HOSTAFINE Blue B2G, HOSTAFINE Rubine F6B, and magenta dry pigment such as Toner Magenta 6BVP2213 and Toner Magenta E02 that may be dispersed in water and/or surfactant prior to use.

Other colorants include, for example, magnetites, such as Mobay magnetites M08029, M08960; Columbian magnetites, MAPICO BLACKS and surface treated magnetites; Pfizer magnetites CB4799, CB5300, CB5600, MCX6369; Bayer magnetites, BAYFERROX 8600, 8610; Northern Pigments magnetites, NP-604, NP-608; Magnox magnetites TMB-100 or TMB-104; and the like, and mixtures thereof. Specific additional examples of pigments include phthalocyanine HELIOGEN BLUE L6900, D6840, D7080, D7020, PYLAM OIL BLUE, PYLAM OIL YELLOW, PIGMENT BLUE 1 available from Paul Uhlrich & Company, Inc., PIGMENT VIOLET 1, PIGMENT RED 48, LEMON CHROME YELLOW DCC 1026, E. D. TOLUIDINE RED and BON RED C available from Dominion Color Corporation, Ltd., Toronto, Ontario, NOVAPERM YELLOW FGL, HOSTAPERM PINK E from Hoechst, and CINQUASIA MAGENTA available from E.I. DuPont de Nemours & Company, and the like. Examples of magentas include, for example, 2,9-dimethyl substituted quinacridone and anthraquinone dye identified in the Color Index as CI-60710, CI Dispersed Red 15, diazo dye identified in the Color Index as CI-26050, CI Solvent Red 19, and the like, and mixtures thereof. Illustrative examples of cyans include copper tetra (octadecyl sulfonamide) phthalocyanine, x-copper phthalocyanine pigment listed in the Color Index as CI74160, CI Pigment Blue, and Anthrathrene Blue identified in the Color Index as DI 69810, Special Blue X-2137, and the like, and mixtures thereof. Illustrative examples of yellows that may be selected include diarylide yellow 3,3-dichlorobenzidene acetoacetanilides, a monoazo pigment identified in the Color Index as CI-12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,4-dimethoxy acetoacetanilide, and Permanent Yellow FGL. Colored magnetites, such as mixtures of MAPICOBLACK and cyan components, may also be selected as pigments.

The colorant, such as carbon black, cyan, magenta, and/or yellow colorant, is incorporated in an amount sufficient to impart the desired color to the toner. In general, pigment or dye is employed in an amount ranging from about 1 to about 35 wt % of the toner particles on a solids basis, such as from about 5 to about 25 wt %, or from about 5 to about 15 wt %.

Coagulants

Coagulants used in emulsion aggregation processes for making toners include monovalent metal coagulants, divalent metal coagulants, polyion coagulants, and the like. As used herein, "polyion coagulant" refers to a coagulant that is a salt or an oxide, such as a metal salt or a metal oxide, formed from a metal species having a valence of at least 3, at least 4, or at least 5. Suitable coagulants include, for example, coagulants based on aluminum such as polyaluminum halides such as polyaluminum fluoride and polyaluminum chloride (PAC), polyaluminum silicates such as polyaluminum sulfosilicate (PASS), polyaluminum hydroxide, polyaluminum phosphate, aluminum sulfate, and the like. Other suitable coagulants include tetraalkyl titinates, dialkyltin oxide, tetraalkyltin oxide hydroxide, dialkyltin oxide hydroxide, aluminum alkoxides, alkylzinc, dialkyl zinc, zinc oxides, stannous oxide, dibutyltin oxide, dibutyltin oxide hydroxide, tetraalkyl tin, and the like. Where the coagulant is a polyion coagulant, the coagulants may have any desired number of polyion atoms present. For example, suitable polyaluminum compounds may have from about 2 to about 13, such as from about 3 to about 8, aluminum ions present in the compound.

The coagulants may be incorporated into the toner particles during particle aggregation. As such, the coagulant may be present in the toner particles, exclusive of external additives and on a dry weight basis, in amounts of from 0 to about 5 wt % of the toner particles, such as from about greater than 0 to about 3 wt % of the toner particles.

Aggregating Agents

Any aggregating agent capable of causing complexation might be used in forming toners of the present disclosure. Both alkaline earth metal or transition metal salts can be utilized as aggregating agents. In embodiments, alkaline earth salts can be selected to aggregate latex resin colloids with a colorant to enable the formation of a toner composite. Such salts include, for example, beryllium chloride, beryllium bromide, beryllium iodide, beryllium acetate, beryllium sulfate, magnesium chloride, magnesium bromide, magnesium iodide, magnesium acetate, magnesium sulfate, calcium chloride, calcium bromide, calcium iodide, calcium acetate, calcium sulfate, strontium chloride, strontium bromide, strontium iodide, strontium acetate, strontium sulfate, barium chloride, barium bromide, barium iodide, and optionally combinations thereof. Examples of transition metal salts or anions which may be utilized as aggregating agent include acetates of vanadium, niobium, tantalum, chromium, molybdenum, tungsten, manganese, iron, ruthenium, cobalt, nickel, copper, zinc, cadmium or silver; acetoacetates of vanadium, niobium, tantalum, chromium, molybdenum, tungsten, manganese, iron, ruthenium, cobalt, nickel, copper, zinc, cadmium or silver; sulfates of vanadium, niobium, tantalum, chromium, molybdenum, tungsten, manganese, iron, ruthenium, cobalt, nickel, copper, zinc, cadmium or silver; and aluminum salts such as aluminum acetate, aluminum halides such as polyaluminum chloride, combinations thereof, and the like.

Sequestering Agents

In embodiments an organic sequestering agent may be added to the mixture during aggregation of the particles. Such sequestering agents and their use in forming toners are described, for example, in U.S. Pat. No. 7,037,633, the disclosure of which is hereby incorporated by reference in its entirety. In embodiments, suitable organic sequestering agents include, for example, organic acids such as ethylene diamine tetra acetic acid (EDTA), GLDA (commercially available L-glutamic acid N,N diacetic acid), humic and fulvic acids, peta-acetic and tetra-acetic acids; salts of organic acids including salts of methylglycine diacetic acid (MGDA), and salts of ethylenediamine disuccinic acid (EDDS); esters of organic acids including sodium gluconate, magnesium gluconate, potassium gluconate, potassium and sodium citrate, nitrotriacetate (NTA) salt; substituted pyranones including maltol and ethyl-maltol; water soluble polymers including polyelectrolytes that contain both carboxylic acid (COOH) and hydroxyl (OH) functionalities; and combinations thereof. Examples of specific sequestering agents include, for example:

EDTA

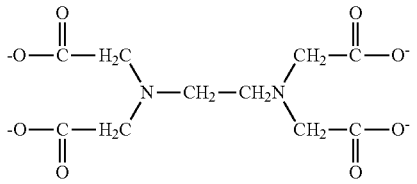

EDDS

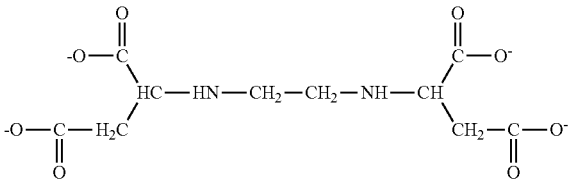

MGDA

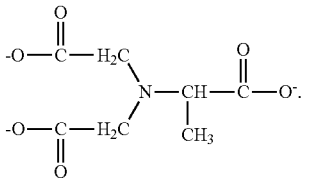

In embodiments, EDTA, a salt of methylglycine diacetic acid (MGDA), or a salt of ethylenediamine disuccinic acid (EDDS), may be utilized as a sequestering agent.

The amount of sequestering agent added may be from about 0.25 pph to about 4 pph, such as from about 0.5 pph to about 2 pph. The sequestering agent complexes or chelates with the coagulant metal ion, such as aluminum, thereby extracting the metal ion from the toner aggregate particles. The amount of metal ion extracted may be varied with the amount of sequestering agent, thereby providing controlled crosslinking. For example, in embodiments, adding about 0.5 pph of the sequestering agent (such as EDTA) by weight of toner, may extract from about 40 to about 60 percent of the aluminum ions, while the use of about 1 pph of the sequestering agent (such as EDTA) may result in the extraction of from about 95 to about 100 percent of the aluminum.

Developer

The toner particles formed from the process disclosed herein may then be formulated into a developer composition. For example, the toner particles may be mixed with carrier particles to achieve a two-component developer composition. The carrier particles can be mixed with the toner particles in various suitable combinations. The toner concentration in the developer may be from about 1% to about 25% by weight of the developer, in embodiments from about 2% to about 15% by weight of the total weight of the developer, or from about 2% to about 10% by weight of the total weight of the developer. In embodiments, the toner concentration may be from about 90% to about 98% by weight of the carrier. However, different toner and carrier percentages may be used to achieve a developer composition with desired characteristics.

Carrier

Illustrative examples of carrier particles that may be selected for mixing with the toner composition prepared in accordance with the present disclosure include those particles that are capable of triboelectrically obtaining a charge of opposite polarity to that of the toner particles. Accordingly, in one embodiment the carrier particles may be selected so as to be of a negative polarity in order that the toner particles that are positively charged will adhere to and surround the carrier particles. Illustrative examples of such carrier particles include granular zircon, granular silicon, glass, silicon dioxide, iron, iron alloys, steel, nickel, iron ferrites, including ferrites that incorporate strontium, magnesium, manganese, copper, zinc, and the like, magnetites, and the like. Other carriers include those disclosed in U.S. Pat. Nos. 3,847,604, 4,937,166, and 4,935,326.

The selected carrier particles can be used with or without a coating. In embodiments, the carrier particles may include a core with a coating thereover which may be formed from a mixture of polymers that are not in close proximity thereto in the triboelectric series. The coating may include polyolefins, fluoropolymers, such as polyvinylidene fluoride resins, terpolymers of styrene, acrylic and methacrylic polymers such as methyl methacrylate, acrylic and methacrylic copolymers with fluoropolymers or with monoalkyl or dialkylamines, and/or silanes, such as triethoxy silane, tetrafluoroethylenes, other known coatings and the like. For example, coatings containing polyvinylidenefluoride, available, for example, as KYNAR 301F™, and/or polymethylmethacrylate, for example having a weight average molecular weight of about 300,000 to about 350,000, such as commercially available from Soken, may be used.

In embodiments, polyvinylidenefluoride and polymethylmethacrylate (PMMA) may be mixed in proportions of from about 30 weight % to about 70 weight %, in embodiments from about 40 weight % to about 60 weight %, or from about 45 weight % to about 55 weight %. The coating may have a coating weight of, for example, from about 0.1 weight % to about 5% by weight of the carrier, in embodiments from about 0.5 weight % to about 2% by weight of the carrier.

In embodiments, PMMA may optionally be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like. The carrier particles may be prepared by mixing the carrier core with polymer in an amount from about 0.05 weight % to about 10 weight %, in embodiments from about 0.01 weight % to about 3 weight %, based on the weight of the coated carrier particles, until adherence thereof to the carrier core by mechanical impaction and/or electrostatic attraction.

Various effective suitable means can be used to apply the polymer to the surface of the carrier core particles, for example, cascade roll mixing, tumbling, milling, shaking, electrostatic powder cloud spraying, fluidized bed, electrostatic disc processing, electrostatic curtain, combinations thereof, and the like. The mixture of carrier core particles and polymer may then be heated to enable the polymer to melt and fuse to the carrier core particles. The coated carrier particles may then be cooled and thereafter classified to a desired particle size.

In embodiments, suitable carriers may include a steel core, for example of from about 25 to about 100 μm in size, in embodiments from about 50 to about 75 μm in size, coated with about 0.5% to about 10% by weight, in embodiments from about 0.7% to about 5% by weight, of a conductive polymer mixture including, for example, methylacrylate and carbon black using the process described in U.S. Pat. Nos. 5,236,629 and 5,330,874.

The carrier particles can be mixed with the toner particles in various suitable combinations. The concentrations are may be from about 1% to about 20% by weight of the toner composition, such as from about 3% to about 18%, or from about 5% to about 15%. However, different toner and carrier percentages may be used to achieve a developer composition with desired characteristics.

The embodiments described herein were shown to provide aggregation control and uniformity in which desired particle size, particle size distribution and shape factor were obtained.

Imaging

Toners formed from the processes disclosed herein may be used in electrostatographic (including electrophotographic) or xerographic imaging methods, including those disclosed in, for example, U.S. Pat. No. 4,295,990, the disclosure of which is hereby incorporated by reference in its entirety. In embodiments, any known type of image development system may be used in an image developing device, including, for example, magnetic brush development, jumping single-component development, hybrid scavengeless development (HSD), and the like.

Imaging processes include, for example, preparing an image with a xerographic device including a charging component, an imaging component, a photoconductive component, a developing component, a transfer component, and a fusing component. In embodiments, the development component may include a developer prepared by mixing a carrier with a toner composition described herein. The xerographic device may include a high speed printer, a black and white high speed printer, a color printer, and the like.

Once the image is formed with toners/developers via a suitable image development method such as any one of the aforementioned methods, the image may then be transferred to an image receiving medium such as paper and the like. In embodiments, the toners may be used in developing an image in an image-developing device using a fuser roll member. Fuser roll members are contact fusing devices that are within the purview of those skilled in the art, in which heat and pressure from the roll may be used to fuse the toner to the image-receiving medium. In embodiments, the fuser member may be heated to a temperature above the fusing temperature of the toner, for example to temperatures of from about 70° C. to about 150° C., in embodiments from about 80° C. to about 145° C., in other embodiments from about 90° C. to about 140° C., after or during melting onto the image receiving substrate.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 25° C.

EXAMPLES

Synthesis Example 1

Preparation of a Toner

An aggregated toner slurry was prepared on a larger scale based on a lab scale formulation which produces a theoretical yield of 150 grams of toner, listed below. About 207 grams of styrene/butyl acrylate resin emulsion, with a solids content of about 42 weight %; about 48 grams of Clariant PY74 yellow pigment aqueous dispersion, having a pigment loading of about 19 weight %; about 465 grams of de-ionized water; and about 50 grams of IGI/Omnova D-1509 aqueous wax dispersion, having a solids content of about 31 weight %, were added to a reactor and mixed. The contents of the reactor were then homogenized using an IKA Ultra Turrax T50 homogenizer operating at about 4000 RPM, during which about 27 grams of flocculent mixture was added drop-wise which was composed of about 0.27 gram poly aluminum chloride, about 2.4 grams de-ionized water, and about 24 grams of 0.02 molar nitric acid solution. As the flocculent mixture was added, the homogenizer speed was increased to about 5200 RPM; after the flocculent mixture was completely added, the mixture was homogenized further for about 5 minutes. After homogenization, the reactor was heated by roughly 1° C./min to a temperature of about 50° C. and held until a volume average particle size of about 4.7-4.9 microns as measured with a Coulter Counter. After this particle size was reached, about 103 grams of another styrene/butyl acrylate resin emulsion was added to the reactor, having a solids content of about 42 weight %, and the mixture was allowed to aggregate at about 50° C. until a volume average particle size of about 5.4-5.6 microns was achieved. The mixture in the reactor was then adjusted to a pH of about 3.3 using 1 molar sodium hydroxide solution, followed by the addition of about 3.6 grams of Versene 100 (ethylenediamine tetraacetate (EDTA) from Dow Chemical) chelating agent, resulting in a pH of about 4.5-4.7. The contents of the reactor were then heated to about 65° C. for about 15 minutes before being discharged for processing by continuous coalescence.

Synthesis Example 2

Preparation of a Toner

An aggregated toner slurry was prepared on a larger scale based on a lab scale formulation which produces a theoretical yield of 150 grams of toner, listed below. About 203 grams of styrene/butyl acrylate resin emulsion, with a solids content of about 42 weight %; about 57 grams of Cabot Regal 330 carbon black pigment aqueous dispersion, having a pigment loading of about 17 weight %; about 515 grams of de-ionized water; and about 55 grams of Baker-Hughes POLYWAX 655 aqueous wax dispersion, having a solids content of about 31 weight %, were added to a reactor and mixed. The contents of the reactor were then homogenized using an IKA Ultra Turrax T50 homogenizer operating at about 4000 RPM, during which about 27 grams of flocculent mixture was added drop-wise which was composed of about 0.27 gram poly aluminum chloride, about 2.4 grams de-ionized water, and about 24 grams of 0.02 molar nitric acid solution. As the flocculent mixture was added, the homogenizer speed was increased to about 5200 RPM; after the flocculent mixture was completely added, the mixture was homogenized further for about 5 minutes. After homogenization, the reactor is heated by roughly 1° C./min to a temperature of about 50° C. and held until the volume average particle size reached about 5.3-5.5 microns as measured with a Coulter Counter. After this particle size was reached, about 103 grams of another styrene/butyl acrylate resin emulsion was added to the reactor, having a solids content of about 42 weight %, and the mixture was allowed to aggregate at about 50° C. until a volume average particle size of about 6.4-7.0 microns was achieved. The mixture in the reactor was then adjusted to a pH of about 4 using 1 molar sodium hydroxide solution, followed by the addition of about 1.2 grams of Versene 100 (ethylenediamine tetraacetate (EDTA) from Dow Chemical) chelating agent, resulting in a pH of about 5.5. The contents of the reactor were then heated to about 65° C. for about 15 minutes before being discharged for processing by continuous coalescence.

Example 1

Toner Prepared by Passing Aggregated Particles Through a Single Heat Exchanger to Coalesce the Particles A glycol bath was heated to 140° C. and passed on the shell-side of a heat exchanger. Once up to temperature, the system was pressurized to 60 psi and water was passed through the heat exchanger by a peristaltic pump at a rate of 90 mL/min to reach steady-state and stabilize the system. Once stable, the pump was switched to the frozen and aggregated toner slurry of Synthesis Example 1 and fed at a rate of 90 mL/min.

The product toner slurry was sampled from a port upstream of the pressurized receiving vessel. The sample was then run on the Coulter Counter particle size analyzer, as well as the SYSMEX® FPIA-2100 flow-type histogram analyzer to measure circularity.

The product toner particles had a mean circularity of 0.977, with a standard deviation of the degree of circularity (circularity SD) of 0.977 and a coefficient of variation of the degree of circularity (circularity CV) of 4.61%, where the circularity CV may be defined by the following formula:

$$Circ.CV = \frac{\text{Standard Deviation of the Degree of Circularity}}{\text{Average Degree of Circularity}} \times 100 = \frac{Circ.SD}{\text{Mean}} \times 100$$

The final average particle size was 5.255 microns with a GSDv of 1.207 and a GSDn of 1.266.

The particle size and circularity of the final toner particles, as compared to the feed material, is summarized in Table 1.

TABLE 1

Experimental Details and Results of Example 1

| | Bath | | | FPIA-2100 | | | Coulter Counter | | |
|---|---|---|---|---|---|---|---|---|---|
| | Temp (° C.) | Temp (° C.) | Feed (mL/min) | Mean Circ. | Circ. SD | Circ. CV | $D_{50v}$ | $GSD_v$ $D_{84}/D_{50}$ | $GSD_n$ $D_{50}/D_{16}$ |
| Feed Material | N/A | 22 | N/A | 0.91 | 0.059 | 6.49% | 5.366 | 1.201 | 1.220 |
| Example 1 | 140 | 132 | 90 | 0.977 | 0.045 | 4.61% | 5.255 | 1.207 | 1.266 |

Examples 2-7

Toner Prepared by Passing Aggregated Particles Through a Series of Three Heat Exchangers A system of three heat exchangers was prepared. A glycol bath was heated to 140° C. and passed on the shell-side of the second heat exchanger. The first and third heat exchangers were connected in a closed loop so as to circulate a glycol-water mixture on the shell-side of the first and third heat exchangers to recover energy from the process and reduce the energy used to preheat the incoming slurry. The system was pressurized to 40 psi with the use of a diaphragm back-pressure regulator. Water was passed through the system by a peristaltic pump at a rate of 240 mL/min to reach steady-state and stabilize the system. Once up to temperature and stable, the pump was switched to the frozen and aggregated toner slurry of Synthesis Example 1, which was continuously fed at a rate of 240 mL/min.

The product toner slurry was sampled directly from the outlet of the backpressure regulator after time intervals of 6 minutes (Example 2), 9 minutes (Example 3), 12 minutes (Example 4), 15 minutes (Example 5), 18 minutes (Example 6), and 21 minutes (Example 7). The samples were then analyzed with a Beckman-Coulter Mastersizer 3 particle size analyzer, as well as with the SYSMEX® FPIA-2100/FPIA-3000 to measure circularity.

The particle size and circularity of the final toner particles produced in Examples 2-7, as compared to the feed material, is summarized in Table 2 (where HEX2 refers to the second heat exchanger). Over time, as the particles were sampled, the mean circularity of the particles improved; that is to say, the mean circularity approached 1.0. The GSDn also improved, in that the GSDn values do not significantly change from that of the feed material.

Examples 8-10

Toner Prepared by Passing Toner Slurry Through a Series of Four Heat Exchangers A system of four standard shell-tube heat exchangers was prepared. A glycol bath was heated to approximately 105° C. and passed on the shell-side of the first heat exchanger. A second glycol bath was heated to approximately 135° C. and passed on the shell-side of the second heat exchanger. A bath of domestic chilled water was passed on the shell-side of the third and fourth heat exchangers. The system was pressurized to 40 psi. Specifically, the system maintained pressure by discharging through a back-pressure regulating diaphragm valve, which allowed for atmospheric discharge and was located between the third and fourth heat exchangers. The system further contained two static mixers, located between the third and fourth heat exchangers, after the back-pressure regulating diaphragm valve.

Water was passed through the system at a rate of 240 mL/min to reach steady state and stabilize the system. Once the system was stable, the pump was switched to the frozen and aggregated toner slurry of Synthesis Example 1, which was fed at a rate of 240 mL/min.

1M NaOH solution was fed at a rate of approximately 4 g/min between the back-pressure regulating diaphragm valve and the first static mixer, yielding a final pH of between 8.7 and 8.9.

The product toner slurry was sampled from the outlet of the fourth heat exchanger. The samples were analyzed on a Beckman-Coulter Mastersizer 3 particle size analyzer, as well as with a Sysmex FPIA-2100/FPIA-3000 to measure circularity.

The particle size and circularity of the final toner particles produced in Examples 8-10, as compared to the feed material, are summarized in Table 3 (where HEX1 refers to the first heat exchanger, and HEX2 refers to the second heat exchanger).

TABLE 2

Experimental Details and Results of Examples 2-7

| | HEX2: Tube-side | HEX2: Shell-side | | FPIA-2100(/3000) | | | Coulter | | |
|---|---|---|---|---|---|---|---|---|---|
| | Temp (° C.) | Temp (° C.) | Flow (mL/min) | Mean Circ. (2100/3000) | Circ. SD | Circ. CV | $D_{50v}$ | $GSD_v$ $D_{84}/D_{50}$ | $GSD_n$ $D_{50}/D_{16}$ |
| Feed Material | RT | N/A | Feed | 0.908/— | 0.059 | 6.47% | 5.422 | 1.195 | 1.220 |
| Example 2 | 120 | 135 | 240 | 0.947 | 0.042 | 4.42% | 5.390 | 1.207 | 1.266 |
| Example 3 | 120 | 135 | 240 | 0.947 | 0.040 | 4.27% | 5.366 | 1.207 | 1.253 |
| Example 4 | 120 | 135 | 240 | 0.946 | 0.043 | 4.51% | 5.369 | 1.207 | 1.253 |
| Example 5 | 120 | 135 | 240 | 0.947/0.964 | 0.041 | 4.31% | 5.366 | 1.207 | 1.259 |
| Example 6 | 120 | 135 | 240 | 0.947 | 0.043 | 4.50% | 5.366 | 1.201 | 1.259 |
| Example 7 | 120 | 135 | 240 | 0.947/0.965 | 0.041 | 4.34% | 5.366 | 1.207 | 1.253 |

TABLE 3

Experimental Details and Results of Examples 8-10.

| | HEX1: Shell-side | HEX2: Shell-side | | FPIA-2100(/3000) | | | Coulter Counter | | |
|---|---|---|---|---|---|---|---|---|---|
| | Temp (° C.) | Temp (° C.) | Flow (mL/min) | Mean Circ. (2100/3000) | Circ. SD | Circ. CV | $D_{50v}$ | $GSD_v$ $D_{84}/D_{50}$ | $GSD_n$ $D_{50}/D_{16}$ |
| Feed Material | RT | N/A | Feed | 0.907/— | 0.056 | 6.14% | 5.422 | 1.195 | 1.220 |
| Example 8 | 105 | 135 | 240 | —/— | — | — | 5.366 | 1.195 | 1.240 |
| Example 9 | 105 | 135 | 240 | 0.949/0.968 | 0.038 | 3.97% | 5.422 | 1.201 | 1.240 |
| Example 10 | 105 | 135 | 240 | 0.949/0.969 | 0.037 | 3.94% | 5.366 | 1.207 | 1.246 |

Example 11

Toner Prepared with Preheating in a Preheating Vessel

The frozen and aggregated toner slurry of Synthesis Example 1 was preheated to a temperature of 65° C. in a preheating vessel.

A system of four heat exchangers was prepared. A first exchanger and a second heat exchanger were heated to 130° C. via a common heating utility, which was connected to the shell side of the first and second heat exchangers in series (counter-currently). A third heat exchanger and a fourth heat exchanger were connected to domestic chilled water, which cooled the outlet tube-side temperature to 63° C. for the third heat exchanger and 45° C. for the second heat exchanger. The system further contained a static mixer situated between the third and fourth heat exchangers.

The system was pressurized to 40 psi using a diaphragm back-pressure regulator situated after the fourth heat exchanger. Water was passed through the system at a rate of 240 mL/min to reach steady-state and stabilize the system. Once the system was stable, the pump was switched to frozen and aggregated toner slurry with a pH of 4.5 and fed at a rate of 240 mL/min. a 1M NaOH solution was fed at a rate of approximately 4 g/min before the static mixer, yielding a final pH between 8.7 and 8.9.

The product toner slurry was sampled from the outlet of the back-pressure regulator. The sample was analyzed on a Beckman-Coulter Mastersizer 3 particle size analyzer and on a Sysmex FPIA-3000.

The particle size and circularity of the final toner particles produced in Example 11, as compared to the feed material, are summarized in Table 4 (where HEX1/2 refers to the first and second heat exchangers, respectively).

TABLE 4

Experimental Details and Results of Example 11

| | Pre-Heat | HEX 1/2: Shell-side | | FPIA-3000 | | | Coulter Counter | | |
|---|---|---|---|---|---|---|---|---|---|
| | Temp (° C.) | Temp (° C.) | Flow (mL/min) | Mean Circ. FPIA-3000 | Circ. SD | Circ. CV | $D_{50v}$ | $GSD_v$ $D_{84}/D_{50}$ | $GSD_n$ $D_{50}/D_{16}$ |
| Feed Material | 65 | N/A | Feed | — | — | — | 6.411 | 1.182 | 1.246 |
| Example 11 | 65 | 130 | 240 | 0.969 | 0.026 | 2.69 | 6.212 | 1.182 | 1.246 |

Example 12

Toner Prepared with Addition of a Length of Tubing to Increase the Time at Temperature, or Residence Time at Temperature The frozen and aggregated toner slurry of Synthesis Example 2 was preheated to a temperature of 65° C. in a preheating vessel.

A system of four heat exchangers was prepared. A first heat exchanger and a second heat exchanger were heated to 130° C. via a common heating utility, which was connected to the shell side of the first and second heat exchangers in series (counter-currently). A third heat exchanger and a fourth heat exchanger were connected to domestic chilled water, which cooled the outlet tube-side temperature to 63° C. for the third heat exchanger and 45° C. for the second heat exchanger. The system further contained a static mixer situated between the third and fourth heat exchangers. The system further contained a length of tubing between heat exchanger 2 and heat exchanger 3 such that the volume of the tubing was approximately 240 mL.

The system was pressurized to 40 psi by regulating pressurized nitrogen to the preheating vessel which is connected to the inlet of heat exchanger 1; this pressure is maintained by use of a peristaltic metering pump connected to the outlet of heat exchanger 4 which volumetrically meters the slurry out of the system without venting the pressure. Water was passed through the system at a rate of 240 mL/min to reach steady-state and stabilize the system. Once the system was stable, the pump was switched to the frozen and aggregated toner slurry with a pH of 4.6 and fed at a rate of 240 mL/min. A 1M NaOH solution was fed at a rate of approximately 4 g/min before the static mixer, yielding a final pH between 8.7 and 8.9.

The product toner slurry was sampled from the outlet of the back-pressure regulating peristaltic pump. The sample was analyzed on a Beckman-Coulter Mastersizer 3 particle size analyzer and on a Sysmex FPIA-3000.

The particle size and circularity of the final toner particles produced in Example 12, as compared to the feed material, are summarized in Table 5 (where HEX1/2 refers to the first and second heat exchangers, respectively).

TABLE 5

Experimental Details and Results of Example 12

| | Pre-Heat | HEX1/2: Shell-side | | FPIA-3000 | | | Coulter Counter | | |
|---|---|---|---|---|---|---|---|---|---|
| | Temp (° C.) | Temp (° C.) | Flow (mL/min) | Mean Circ. FPIA-3000 | Circ. SD | Circ. CV | $D_{50v}$ | $GSD_v$ $D_{84}/D_{50}$ | $GSD_n$ $D_{50}/D_{16}$ |
| Feed Material | 65 | N/A | Feed | — | — | — | 6.411 | 1.195 | 1.246 |
| Example 12 | 65 | 130 | 240 | 0.975 | — | — | 6.212 | 1.195 | 1.259 |

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A method of making toner particles, the method comprising:

forming a slurry comprising particles by mixing together an emulsion comprising:

a latex of at least one polymer resin, optionally a wax dispersion, optionally a colorant dispersion, and optional additives dispersions;

aggregating the particles from the slurry;

optionally adding a second polymer latex and further aggregating the particles to form a shell on the particles;

freezing aggregation of the particles;

coalescing the aggregated particles to form toner particles by continuously passing the particles through a system comprises at least two heat exchangers and comprises a first heat exchanger and a second heat exchanger; wherein the first heat exchanger is heated to a temperature greater than the glass transition temperature of the resin but less than the temperature of the second heat exchanger, and the second heat exchanger is heated to a temperature of from about 100° C. to about 150° C.; and recovering toner particles from the system comprising at least two heat exchangers;

the circularity of the particles before entering the system comprising at least one heat exchanger is between about 0.900 and about 0.940, and the circularity of the toner particles recovered from the system is between about 0.940 and about 0.999 and wherein the circularity is reached with a residence time of from 1 second to 15 minutes, and after the aggregated particles are coalesced to form toner particles, the toner particles are cooled;

wherein the coalescing is completed within the residence time;

wherein the aggregated particles are continuously added to the system and the toner particles are recovered continuously from the system.

2. The method according to claim 1, wherein the process further comprising preheating the particles, and further wherein aggregating the particles, freezing the particles, and preheating the particles to a temperature greater than the glass transition of the resin but less than the coalescence temperature all takes place within the same vessel.

3. The method according to claim 1, wherein the temperature of the first heat exchanger preheats the toner slurry to a temperature of from about 5° C. greater than the glass transition temperature of the resin to about 30° C. greater than the glass transition temperature of the resin.

4. The method according to claim 1, wherein at least one of the at least two heat exchangers is at a temperature of from about 100° C. to about 115° C., and at least one of the at least two heat exchangers is at a temperature of from about 115° C. to about 150° C.

5. The method according to claim 1, wherein the system comprises at least three heat exchangers and comprises a first heat exchanger, a second heat exchanger and a third heat exchanger; and further wherein the first heat exchanger of the at least three heat exchangers is at a temperature of from about 100° C. to about 115° C.;

the second heat exchanger of the at least three heat exchangers is at a temperature of from about 115° C. to about 150° C.; and the third heat exchanger of the at least three heat exchangers is at a temperature that quenches the temperature of the toner slurry after it exits the second heat exchanger.

6. The method according to claim 1, wherein the temperature of one of the at least two heat exchangers is between about 120° C. and about 145° C.

7. The method according to claim 1, wherein the temperature of one of the at least two heat exchangers is between about 130° C. and about 140° C.

8. The method according to claim 1, wherein one of the at least two heat exchangers is pressurized to a pressure from 1% to 20% greater than the vapor pressure of water at the temperature of the heat exchanger.

9. A method of making toner particles, the method comprising:

forming a slurry comprising particles by mixing together at least one emulsion comprising:

a latex of at least one polymer resin, optionally a wax dispersion, optionally a colorant dispersion, and optional additives dispersions;

aggregating the particles from the slurry;

optionally adding a second polymer latex and further aggregating the particles to form a shell on the particles;

freezing aggregation of the particles;

coalescing the aggregated particles to form toner particles by continuously passing the particles through a system comprising at least three heat exchangers; and recovering toner particles from the system comprising at least three heat exchangers; wherein the at least three heat exchangers comprises a first, a second and a third heat exchangers; wherein the first heat exchanger and the third heat exchanger are connected in a closed loop, and the second heat exchanger is located between the first heat exchanger and the third heat exchanger;

wherein the second heat exchanger of the at least three heat exchangers is at a temperature of from about 100° C. to about 150° C.;

the circularity of the particles before entering the heat exchanger system is between about 0.900 and about 0.940, and the circularity of the toner particles recovered from the system is between about 0.940 and about 0.999 and wherein the circularity is reached with a residence time of from 1 second to 15 minutes; and after the aggregated particles are coalesced to form toner particles, the toner particles are cooled;

wherein the coalescing is completed within the residence time;

wherein the aggregated particles are continuously added to the system and the toner particles are recovered continuously from the system.

10. The method according to claim 9, wherein the system is pressurized.

11. The method according to claim 9, wherein the first heat exchanger increases the temperature of the incoming slurry before it enters the second heat exchanger, and the third heat exchanger decreases the temperature of the slurry after it exits the second heat exchanger.

* * * * *